US011386826B1

(12) United States Patent
Cok et al.

(10) Patent No.: US 11,386,826 B1
(45) Date of Patent: Jul. 12, 2022

(54) FLAT-PANEL PIXEL ARRAYS WITH SIGNAL REGENERATION

(71) Applicant: X Display Company Technology Limited, Dublin (IE)

(72) Inventors: Ronald S. Cok, Rochester, NY (US); Matthew Alexander Meitl, Durham, NC (US)

(73) Assignee: X Display Company Technology Limited, Dublin (IE)

( * ) Notice: Subject to any disclaimer, the term of this patent is extended or adjusted under 35 U.S.C. 154(b) by 0 days.

(21) Appl. No.: 17/355,079

(22) Filed: Jun. 22, 2021

(51) Int. Cl.
*G09G 3/20* (2006.01)

(52) U.S. Cl.
CPC ..... *G09G 3/20* (2013.01); *G09G 2300/0404* (2013.01); *G09G 2300/0426* (2013.01)

(58) Field of Classification Search
CPC ... G09G 2300/0809; G09G 2300/0426; G09G 2300/0404
See application file for complete search history.

(56) References Cited

U.S. PATENT DOCUMENTS

| | | | | |
|---|---|---|---|---|
| 5,550,066 | A | 8/1996 | Tang et al. | |
| 7,622,367 | B1 | 11/2009 | Nuzzo et al. | |
| 8,207,954 | B2 | 6/2012 | Cok et al. | |
| 8,506,867 | B2 | 8/2013 | Menard | |
| 8,722,458 | B2 | 5/2014 | Rogers et al. | |
| 9,520,537 | B2 | 12/2016 | Bower et al. | |
| 9,930,277 | B2 | 3/2018 | Cok | |
| 9,991,163 | B2 | 6/2018 | Bower et al. | |
| 10,468,397 | B2 | 11/2019 | Cok | |
| 10,475,876 | B2 | 11/2019 | Bower et al. | |
| 11,282,439 | B2 | 3/2022 | Cok et al. | |
| 2012/0206421 | A1* | 8/2012 | Cok | G09G 3/2085 345/204 |
| 2014/0151534 | A1* | 6/2014 | Choo | H04N 5/3742 250/208.1 |
| 2016/0093600 | A1 | 3/2016 | Bower et al. | |
| 2018/0019747 | A1 | 1/2018 | Ikegawa et al. | |
| 2018/0191978 | A1* | 7/2018 | Cok | G09G 3/3208 |
| 2022/0069154 | A1 | 3/2022 | Bower et al. | |
| 2022/0122520 | A1 | 4/2022 | Cok et al. | |

OTHER PUBLICATIONS

Cok, R. S. et al., Inorganic light-emitting diode displays using micro-transfer printing, Journal of the SID, 25(10):589-609, (2017).

* cited by examiner

*Primary Examiner* — Gerald Johnson
(74) *Attorney, Agent, or Firm* — Choate, Hall & Stewart LLP; Michael D. Schmitt

(57) ABSTRACT

A flat-panel display comprises an array of pixels distributed in rows and columns. A first wire segment is electrically connected to a first subset of pixels in a row or column of pixels that conducts a signal between a controller and the first subset of pixels, and a second wire segment is electrically connected to a second subset of pixels in the row or column of pixels. A signal regeneration circuit electrically connected to the first wire segment and to the second wire segment regenerates a signal conducted on the first wire segment and drives the regenerated signal onto the second wire segment or regenerates a signal conducted on the second wire segment and drives the regenerated signal onto the first wire segment.

22 Claims, 12 Drawing Sheets

FLAT-PANEL PIXEL ARRAYS WITH SIGNAL REGENERATION

CROSS REFERENCE TO RELATED APPLICATIONS

Reference is made to U.S. patent application Ser. No. 17/074,596, filed Oct. 19, 2020, entitled Pixel Group and Column Display Architectures by Bower and Cok and to U.S. patent application Ser. No. 17/074,600, entitled Pixel Group and Column Display Architectures by Cok and Bower, the disclosures of which are incorporated herein by reference in their entirety.

FIELD OF THE DISCLOSURE

The present disclosure relates to flat-panel pixel array architectures that use row and column control signals (e.g., in a display or camera).

BACKGROUND OF THE DISCLOSURE

Flat-panel displays are widely used in conjunction with computing devices, in portable electronic devices, and for entertainment devices such as televisions. Such displays typically employ an array of pixels distributed over a display substrate to display images, graphics, or text. In a color display, each pixel includes light emitters that emit light of different colors, such as red, green, and blue. For example, liquid crystal displays (LCDs) employ liquid crystals to block or transmit light from a backlight behind the liquid crystals and organic light-emitting diode (OLED) displays rely on passing current through a layer of organic material that glows in response to the current. Displays using inorganic light-emitting diodes (LEDs) as pixel elements are also in widespread use for outdoor signage and have been demonstrated in a 55-inch television.

Displays are typically controlled with either a passive-matrix (PM) control scheme employing electronic control circuitry external to the pixel array or an active-matrix (AM) control scheme employing electronic control circuitry in each pixel on the display substrate associated with each light-emitting element. Both OLED displays and LCDs using passive-matrix control and active-matrix control are available. An example of such an AM OLED display device is disclosed in U.S. Pat. No. 5,550,066.

In a PM-controlled display, each pixel in a row is stimulated to emit light at the same time while the other rows do not emit light, and each row is sequentially activated at a high rate to provide the illusion that all of the rows simultaneously emit light. In contrast, in an AM-controlled display, data is concurrently provided to and stored in pixels in a row and the rows are sequentially activated to load the data in the activated row. Each pixel emits light corresponding to the stored data when pixels in other rows are activated to receive data so that all of the rows of pixels in the display emit light at the same time, except the row loading pixels. In such AM systems, the row activation rate can be much slower than in PM systems, for example divided by the number of rows. Active-matrix elements are not necessarily limited to displays and can be distributed over a substrate and employed in other applications requiring spatially distributed control.

Active-matrix circuits are commonly constructed with thin-film transistors (TFTs) in a semiconductor layer formed over a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors. Additional layers, for example insulating dielectric layers and conductive metal layers are provided, often by evaporation or sputtering, and photolithographically patterned to form electrical interconnections, or wires. In some implementations, small integrated circuits (ICs) with a separate IC substrate are disposed on a display substrate and control pixels in an AM display. The integrated circuits can be disposed on the display substrate using micro-transfer printing, for example as taught in U.S. Pat. No. 9,930,277.

For both PM and AM displays, relatively large display substrates having wires with limited electrical conductivity inhibit power, ground, and signal distribution and these signals can degrade over the display substrate, leading to difficulties in proper pixel control. Such problems become increasing problematic as the display substrate size and the number of pixels increase. There is a need, therefore, for display systems and architectures that provide improved signal distribution over relatively large displays.

SUMMARY

The present disclosure includes, among various embodiments, a flat-panel pixel array (e.g., a display or camera) comprising an array of pixels distributed in rows and columns. A first wire segment is electrically connected to a first subset of pixels in a row or column of pixels (e.g., that conducts a signal between a controller and the first subset of pixels), and a second wire segment is electrically connected to a second subset of pixels in the row or column of pixels. A signal regeneration circuit electrically connected to the first wire segment and to the second wire segment regenerates a signal conducted on the first wire segment and drives the regenerated signal onto the second wire segment or regenerates a signal conducted on the second wire segment and drives the regenerated signal onto the first wire segment. The first subset of pixels is mutually exclusive with respect to the second subset of pixels. The array of pixels can be an array of energy-emitting pixels or an array of energy-sensing pixels. The flat-panel pixel array can be a display or an image sensor.

According to some embodiments of the present disclosure, a flat-panel pixel array comprises a substrate and (i) the array of pixels is disposed on the substrate, (ii) the first wire segment is disposed on the substrate, (iii) the second wire segment is disposed on the substrate, (iv) the signal regeneration circuit is disposed on the substrate, or (v) any combination of (i), (ii), (iii), and (iv). According to some embodiments of the present disclosure, (i) the pixels in the first subset of pixels are adjacent, (ii) the pixels in the second subset of pixels are adjacent, (iii) the first wire segment is adjacent to the second wire segment, or (iv) any combination of (i), (ii), and (iii).

According to some embodiments of the present disclosure, the pixels in the array of pixels comprise inorganic light-emitting diodes, for example micro-light-emitting diodes.

According to some embodiments of the present disclosure, a third wire segment is electrically connected to a third subset of pixels in the row or column of pixels. A signal regeneration circuit electrically connected to the second wire segment and to the third wire segment regenerates a signal conducted on the second wire segment and drives the regenerated signal onto the third wire segment or regenerates a signal conducted on the third wire segment and drives the regenerated signal onto the second wire segment.

Some embodiments of the present disclosure comprise an array substrate and the signal regeneration circuit comprises a thin-film circuit disposed on the array substrate. Some embodiments of the present disclosure comprise an array substrate and the signal regeneration circuit is a signal regeneration integrated circuit having a circuit substrate distinct (e.g., separate, individual, or independent) from the array substrate. The signal regeneration integrated circuit can be a micro-transfer printed integrated circuit comprising or physically attached to a broken (e.g., fractured) or separated tether.

One or more pixels in the array of pixels can comprise a pixel control circuit responsive to or forming the signal. The pixel control circuit can be an integrated circuit having a circuit substrate distinct (e.g., separate, individual, or independent) from the substrate. The integrated circuit can be a micro-transfer printed integrated circuit comprising or physically attached to a broken (e.g., fractured) or separated tether. The pixel control circuit and the signal regeneration circuit can be comprised (e.g., disposed) in a common integrated circuit.

According to some embodiments of the present disclosure, the first wire segment and the second wire segment are first and second row wire segments electrically connected to at least a portion of a row of pixels, the first and second subsets of pixels are first and second row subsets (e.g., wherein the controller is a row controller), the signal regeneration circuit is a row signal regeneration circuit, the signal is a row signal, and a flat-panel pixel array comprises a first column wire segment electrically connected to a first column subset of pixels in a column of pixels (e.g., that conducts a signal between a column controller and the first column subset of pixels), a second column wire segment electrically connected to a second column subset of pixels in the column of pixels, and a column signal regeneration circuit electrically connected to the first column wire segment and to the second column wire segment that regenerates a column signal conducted on the first column wire segment and drives the regenerated column signal onto the second column wire segment or that regenerates a column signal conducted on the second column wire segment and drives the regenerated column signal onto the first column wire segment.

According to some embodiments, the first subset of pixels comprises one pixel (e.g., the first subset of pixels is a single pixel), the second subset of pixels comprises one pixel (e.g., the second subset of pixels is a single pixel), and embodiments comprise a separate wire segment electrically connected to each pixel in the row or column of pixels and a separate signal regeneration circuit electrically connected to each separate wire segment and to a wire segment adjacent to each separate wire segment in the row or column of pixels that regenerates a signal conducted on each the separate wire segment and drives the regenerated signal onto the adjacent wire segment or that regenerates a signal conducted on the adjacent wire segment and drives the regenerated signal onto the each separate wire segment.

According to some embodiments of the present disclosure, first and second wire segments are electrically connected to first and second subsets of pixels in each row or column of pixels. The first subset of pixels electrically conducts a signal between the controller and the first subset of pixels. A separate signal regeneration circuit electrically connected to the first wire segment and to the second wire segment of each row or column regenerates a signal conducted on the first wire segment of the row or column and drives the regenerated signal onto the second wire segment of the row or column or regenerates a signal conducted on the second wire segment of the row or column and drives the regenerated signal onto the first wire segment of the row or column.

According to some embodiments, each of the pixels comprises one or more inorganic micro-light-emitting-diodes and each of the one or more inorganic micro-light-emitting-diodes has a length and a width each no greater than 200 microns.

The signal (e.g., a row or column control or data signal) can be an analog or a digital signal. The flat-panel pixel array can be a passive-matrix-controlled pixel array or an active-matrix-controlled pixel array.

In some embodiments, a flat-panel pixel array (e.g., a display or camera) comprises an array of pixels distributed in rows and columns and electrically connected with row lines and column lines (e.g., each comprising two or more line segments). The flat-panel pixel array can further comprise an array of signal regeneration circuits (e.g., integrated circuits) distributed throughout the array of pixels, wherein each of the signal regeneration circuits is independently electrically to two or more of the row lines and two or more of the column lines. In some embodiments, a flat-panel pixel array (e.g., a display or camera) comprises an array of pixels distributed in rows and columns and electrically connected with row lines and column lines. The flat-panel pixel array can further comprise a plurality of signal regeneration circuits, wherein each of the signal regeneration circuits is electrically connected to at least one of the row lines or column lines and operable to regenerate a signal conducted on the at least one of the row lines or column lines.

Embodiments of the present disclosure provide active and passive display control methods and architectures that enable improved distribution of control signals for flat-panel displays with a relatively large substrate and number of pixels.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

Figure 1A:
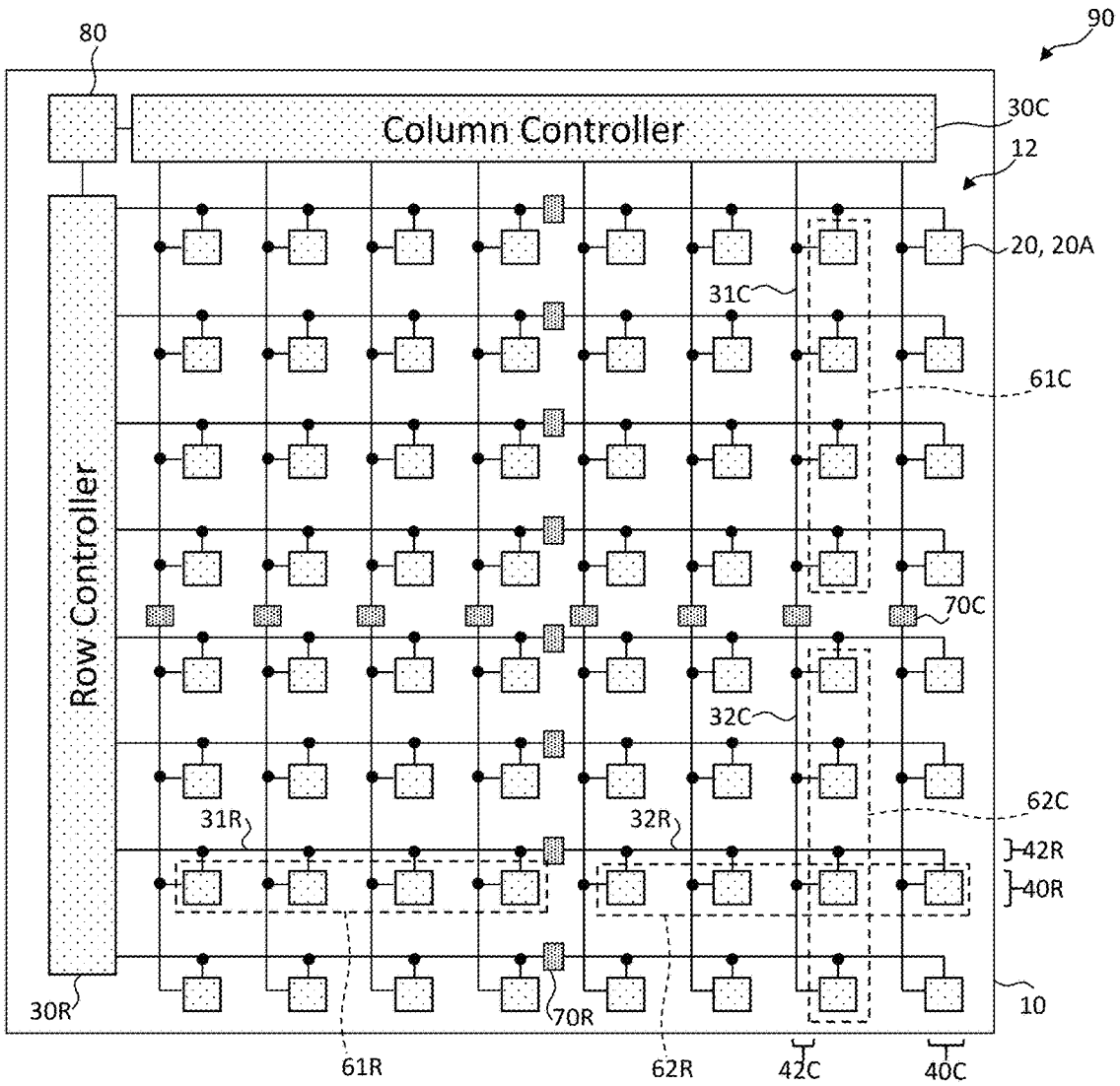
FIGS. 1A and 1B are schematic diagrams of displays having row and column signal regeneration circuits according to illustrative embodiments of the present disclosure.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF CERTAIN EMBODIMENTS

The row and column signal driving circuits in a matrix-addressed flat-panel pixel array disposed on a substrate must electrically drive row and column signals at the desired frequency and distance over the substrate and maintain row and column signal integrity to every row and column of pixels in the array. For large arrays driven at a fast frame rate on a large substrate, the row and column signals can degrade because of row and column line resistance, parasitic capacitance and inductance, and transmission line impedance discontinuities. Embodiments of the present disclosure provide, inter alia, pixel array control methods and architectures that enable improved control and signal distribution for flat-panel arrays (e.g., flat-panel arrays with a relatively large substrate and many pixels). The pixels can comprise inorganic light-emitting diodes or photosensors and the pixel arrays can comprise analog or digital pixels in displays or image sensors, respectively. In some embodiments, the pixels can comprise micro-LEDs and the flat-panel pixel array can be a micro-LED display with a small aperture ratio (e.g., a small fill factor having a small light-emitting area compared to a display area of the pixel array). As noted in U.S. Pat. No. 9,991,163 entitled Small-Aperture-Ratio Display with Electrical Component, a small-aperture-ratio display can comprise additional active electrical components located on the display substrate at least partly directly between the pixel elements in a display area of the display.

Figure 1B:
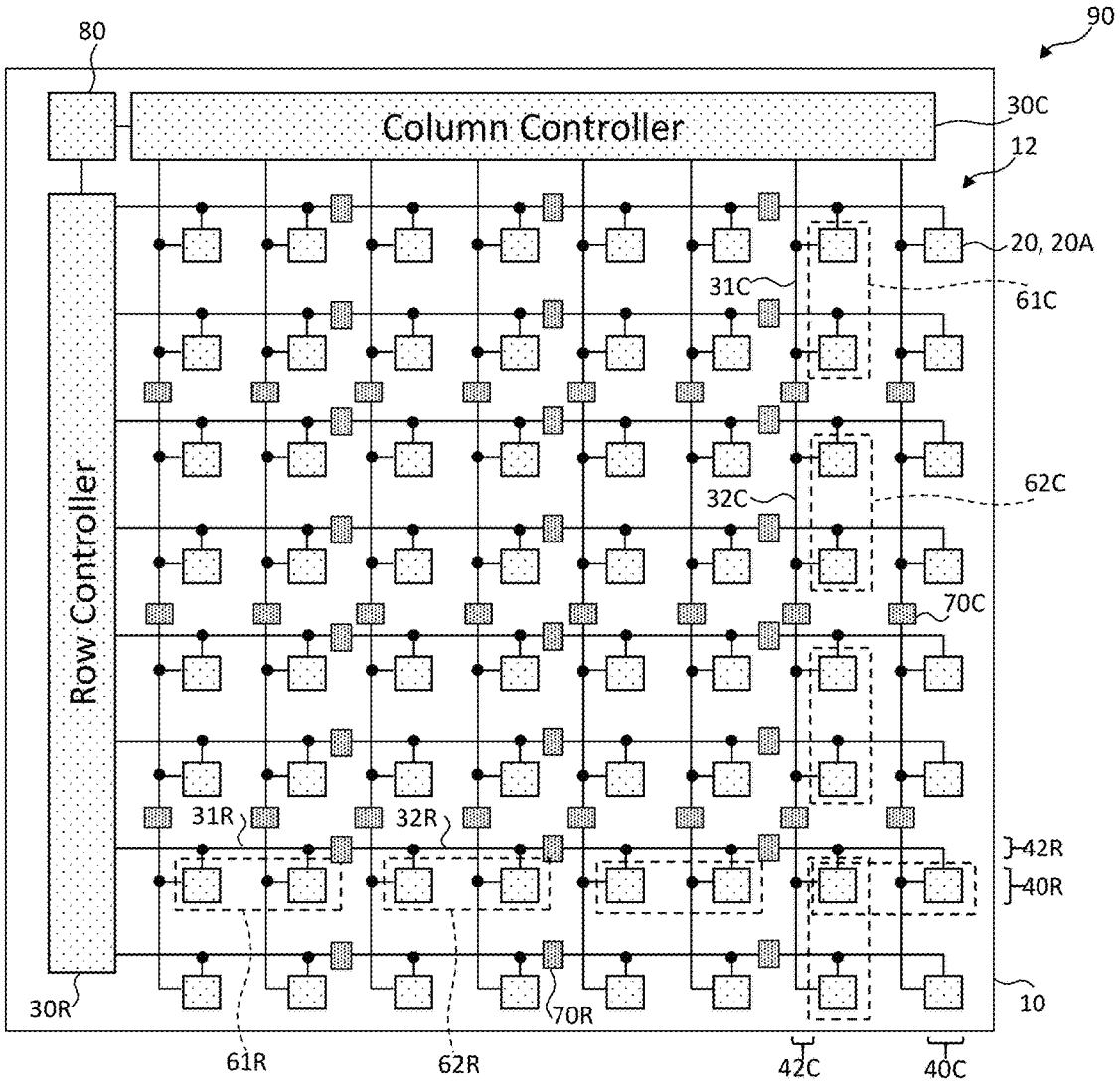

According to embodiments of the present disclosure and as illustrated in FIGS. 1A and 1B, a flat-panel pixel array 90 comprises an array 12 of pixels 20 distributed in pixel rows 40R and pixel columns 40C disposed on an array substrate 10. Array substrate 10 can be, for example, a display substrate 10 or an image sensor substrate 10. Each pixel row 40R of pixels 20 is electrically connected to a row line 42R and each pixel column 40C of pixels 20 is electrically connected to a column line 42C. According to embodiments of the present disclosure, each row line 42R comprises multiple separate row wire segments (e.g., first row wire segment 31R and second row wire segment 32R), each column line 42C comprises multiple separate column wire segments (e.g., first column wire segment 31C and second column wire segment 32C), or both, as shown in FIGS. 1A and 1B.

First column wire segment 31C electrically connected to a first column subset 61C of pixels 20 in a pixel column 40C of pixels 20 conducts a column signal between a column controller 30C and first column subset 61C of pixels 20 in pixel column 40C. Second column wire segment 32C is electrically connected to a second column subset 62C of pixels 20 in pixel column 40C of pixels 20. First and second column wire segments 31C, 32C can be disposed on array substrate 10 and can be adjacent so that no other column wire segments are between the adjacent column wire segments. Pixels 20 in first column subset 61C can be adjacent and pixels 20 in second column subset 62C can be adjacent so that no pixels 20 are between pixels 20 in first column subset 61C and no pixels 20 are between pixels 20 in second column subset 62C. No pixels 20 not in a column subset are between adjacent pixels 20 in a column subset. First and second column subsets 61C, 62C of pixels 20 in each pixel column 40C can be mutually exclusive and adjacent. A column signal regeneration circuit 70C is electrically connected to first column wire segment 31C and to second column wire segment 32C and can be disposed on array substrate 10. According to some embodiments, a column signal regeneration circuit 70C regenerates a column signal conducted on first column wire segment 31C and drives the regenerated signal onto second column wire segment 32C. According to some embodiments, column signal regeneration circuit 70C regenerates a column signal conducted on second column wire segment 32C and drives the regenerated signal onto first column wire segment 31C.

Similarly, according to some embodiments of the present disclosure and as also illustrated in FIG. 1A, first row wire segment 31R is electrically connected to a first row subset 61R of pixels 20 in a pixel row 40R of pixels 20 and conducts a row signal between a row controller 30R and first row subset 61R of pixels 20 in the row. Second row wire segment 32R is electrically connected to a second row subset 62R of pixels 20 in pixel row 40R of pixels 20. First and second row wire segments 31R, 32R can be disposed on array substrate 10 and can be adjacent so that no other row wire segments are between the adjacent row wire segments. Pixels 20 in first row subset 61R can be adjacent and pixels 20 in second row subset 62R can be adjacent so that no pixels 20 are between pixels 20 in first row subset 61R and no pixels 20 are between pixels 20 in second column subset 62R. No pixels 20 not in a row subset are between adjacent pixels 20 in a row subset. First and second row subsets 61R, 62R of pixels 20 in each pixel row 40R can be mutually exclusive and adjacent. A row signal regeneration circuit 70R is electrically connected to first row wire segment 31R and to second row wire segment 32R. According to some embodiments, a row signal regeneration circuit 70R regenerates a row signal conducted on first row wire segment 31R and drives the regenerated signal onto second row wire segment 32R. According to some embodiments, row signal regeneration circuit 70R regenerates a signal conducted on second row wire segment 32R and drives the regenerated signal onto first row wire segment 31R.

According to some embodiments, column signal regeneration circuits 70C are disposed on display substrate 10 within the display area of flat-panel pixel array 90 and within array 12 of pixels 20 between pixels 20 and between pixel rows 40R or pixel columns 40C, or both. According to some embodiments, row signal regeneration circuits 70R are disposed on display substrate 10 within the display area of flat-panel pixel array 90 and within array 12 of pixels 20 between pixels 20 and between pixel rows 40R or pixel columns 40C, or both. In some embodiments, an array of signal regeneration circuits 70 is distributed throughout an array of pixels 20. For example, each of a plurality of signal regeneration circuits 70 can be disposed between two or more row lines 42R or two or more column lines 42C or both. In some embodiments, each signal regeneration circuit 70 is disposed within a display area defined by a convex hull of pixels 20 in pixel array 12.

According to some embodiments of the present disclosure, a flat-panel pixel array 90 comprises both first and second row and column wire segments 31R, 32R, 31C, 32C and row and column signal regeneration circuits 70R, 70C that regenerate row and column signals on first and second row and column wire segments 31R, 32R, 31C, 32C, respectively. Pixel 20 array 12 can be controlled by a pixel array controller 80.

FIG. 1A illustrates embodiments of the present disclosure having first and second wire segments 31, 32 for each of pixel rows 40R and pixel columns 40C, respectively, in array 12 of pixels 20. According to embodiments of the present disclosure and as shown in FIG. 1B, each row or column can be divided into more than two mutually exclusive subsets (e.g., first and second row and column subsets 61R, 62R, 61C, 62C) of pixels 20, each subset of pixels 20 connected to a different row or column wire segment (e.g., first or second row or column wire segment 31R, 31C, 32R, 32C). For example, FIG. 1A illustrates two subsets of pixels 20, each an 8 by 4 array 12 of pixels 20 connected to each wire segment. The 8 by 8 array 12 of pixels 20 could be divided into four 8 by 2 arrays 12 of pixels 20 each connected to a separate wire segment. For example, pixel columns 40C of pixels 20 in the top two pixel rows 40R of pixels 20 (rows 1 and 2) can each be connected to a first column wire segment 31C, rows 3 and 4 could each be connected to a second column wire segment 32C, rows 5 and 6 could each be connected to a third column wire segment, and rows 7 and 8 could each be connected to a fourth column wire segment. Similarly, pixel rows 40R of pixels 20 in the left two pixel columns 40C of pixels 20 (columns 1 and 2) could each be connected to a first row wire segment 31R, columns 3 and 4 could each be connected to a second row wire segment 32R, columns 5 and 6 could each be connected to a third row wire segment, and columns 7 and 8 could each be connected to a fourth row wire segment. Each adjacent pair of row or column wire segments can be indirectly connected through a signal regeneration circuit 70. The number of row and column wire segments can be the same or different, can be connected to the same or different numbers of rows or columns, respectively, and can be selected based on the number of rows and columns in pixel 20 array 12, the size of array substrate 10, and the desired voltage, current, and frequency of the signals. At higher frequencies, voltages, and currents for larger displays or image sensors with more pixels 20 more wire segments can be useful.

As used in the present disclosure, row and column designations are arbitrary and can be interchanged. Accordingly, first row or column wire segments 31R, 31C are collectively first wire segments 31, second row or column wire segments 32R, 32C are collectively second wire segments 32, and row and column signal regeneration circuits 70R, 70C are collectively signal regeneration circuits 70.

According to some embodiments, flat-panel pixel array 90 is a display and array substrate 10 is a display substrate 10 comprising a display controller 80, row controller 30R drives row signals onto first row wire segment 31R, row signal regeneration circuit 70R regenerates the row signal on first row wire segment 31R and drives the regenerated row signal onto second row wire segment 32R, column controller 30C drives column signals onto first column wire segment 31C, and column signal regeneration circuit 70C regenerates the column signal on first column wire segment 31C and drives the regenerated column signal onto second column wire segment 32C. Pixels 20 can comprise one or more light emitters and drivers and the row and column signals from first and second wire segments 31, 32 can control pixels 20 to emit light. Thus, according to some embodiments of the present disclosure, array 12 of pixels 20 in flat-panel pixel array 90 comprises an array 12 of energy-emitting pixels 20 (e.g., light-emitting pixels 20 comprising inorganic micro-light-emitting diodes 50).

According to some embodiments, flat-panel pixel array 90 is an image sensor disposed on an image sensor substrate 10 comprising an image sensor controller 80, row controller 30R receives row signals from first row wire segment 31R, row signal regeneration circuit 70R regenerates the row signal on second row wire segment 32R and drives the regenerated row signal onto first row wire segment 31R, column controller 30C receives column signals from first column wire segment 31C, and column signal regeneration circuit 70C regenerates the column signal on second column wire segment 32C and drives the regenerated column signal onto first column wire segment 31C. Pixels 20 can comprise one or more light sensors and pixels 20 can drive the row or column signals onto first and second wire segments 31, 32 with sensed-light signals. Light sensors can sense any desired electromagnetic frequencies. Thus, according to some embodiments of the present disclosure, array 12 of pixels 20 in flat-panel pixel array 90 comprises an array 12 of energy-sensing pixels 20 (e.g., energy-sensing pixels 20 such as photosensors).

As shown in FIGS. 2-4C, pixels 20 are each an individual element in array 12 on array substrate 10 that emits or senses signals (e.g., image optical signals), and can comprise a pixel control circuit 24 (e.g., an electrical circuit comprising active elements such as transistors in an integrated circuit such as a bare unpackaged die having a circuit substrate distinct (e.g., separate, individual, or independent) from and non-native to array substrate 10 or a thin-film circuit disposed on and native to array substrate 10) disposed on array substrate 10 or in a pixel module with a pixel substrate 28 disposed on array substrate 10 and one or more light emitters 50 (e.g., light-emitting diodes or inorganic micro-light-emitting diodes) or light sensors 50 (e.g., photosensors). In some embodiments, pixel control circuit 24 includes a circuit substrate distinct from any array substrate 10 or circuit substrate of a signal regeneration circuit 70. In some embodiments, signal regeneration circuit 70 includes a circuit substrate distinct from any array substrate 10 or circuit substrate of a pixel control circuit 24. The emitted or sensed signals are controlled (e.g., sent or received) from row or column controllers 30R, 30C through signal lines (e.g., row and column lines 42R, 42C such as wires comprising metal) disposed over array substrate 10 and designed to transmit electrical signals corresponding to the emitted or sensed signals. Row or column controllers 30R, 30C can be integrated circuits providing control, input and output signals, for example onto row or column lines 42R, 42C. First and second row and column wire segments 31R, 32R, 31C, 32C can be electrically conductive wires or traces disposed on array substrate 10 and formed using photolithographic methods and materials, for example comprising metal, metal alloys, transparent conductive metal oxides, or electrically conductive polymers. Individual wire segments in a row (e.g., first and second row wire segments 31R, 32R of row line 42R) or column (e.g., first and second column wire segments 31C, 32C of column line 42C) are not directly electrically connected (e.g., do not form a single conductor or wire) but are connected in series through signal regeneration circuits 70.

The signal lines that transmit the electrical signals have a resistance, parasitic capacitance, inductance, and reactance, and can have transmission line impedance discontinuities (e.g., IR drop and impedance of the signal lines) that limit the rate that data can be transmitted on the signal lines and hence the refresh rate and size of array 12 of pixels 20 on array substrate 10. More powerful drive circuitry in row or column controllers 30R, 30C or pixels 20 and careful transmission line design can mitigate, but not eliminate, this limitation. According to some embodiments of the present disclosure, the signal lines (e.g., row lines 42R and column lines 42C) each comprising a plurality of wire segments are connected in series through signal regeneration circuits 70. Each signal regeneration circuit 70 can input transmitted signals and output them at a higher voltage or current or improved wave form (e.g., with shorter rise and fall times). Signal regeneration circuits 70 can be integrated circuits (e.g., a bare unpackaged die) disposed on and non-native to array substrate 10 or a thin-film circuit constructed in a thin semiconductor film disposed on and native to array substrate 10. Since the wire segments are shorter than the entire signal line, the transmitted signals on the wire segments do not degrade to the same extent as an array with only one continuous wire for each row or column line 42R, 42C disposed over the entire extent of array 12 of pixels 20 on array substrate 10. Thus, embodiments of the present disclosure enable effective control of pixel 20 arrays 12 with more pixels 20 in arrays 12 disposed and distributed over larger array substrates 10.

Prior-art pixel array designs can employ daisy chaining, for example as described in U.S. Pat. No. 8,207,954 entitled "Display device with chiplets and hybrid drive." In a daisy chain, a signal is input by a first device, stored, and then forwarded to a second device at a later time, typically driven by a clock. For example, a signal is first input into the first device at a first clock cycle and stored in a first register. At a second clock cycle, a second device inputs the signal from the first register and stores the signal in a second register. The signal propagates through the chain of serially connected storage devices at a rate of one device per clock cycle so that the devices essentially form a first-in first-out serial shift register. Thus, a signal will be transmitted entirely through a daisy chained series of N devices in N clock cycles. Each storage device can regenerate the signal transmitted to the next storage device in the shift register.

In contrast, embodiments of the present disclosure do not store a signal in each signal regeneration circuit 70, a temporal delay between the presentation of the signal on a row line 42R or column line 42C and the signals propagation along the entire line is equal to the switching time of the signal regeneration circuits 70 in the entire line plus the propagation of the signal along the wire. Since transistors can switch at a rate of many hundreds or thousands of megahertz and the IR drop and impedance of the wire segments is much lower than that of an entire row or column line 42R, 42C, the temporal delay between the presentation of the signal on a row line 42R or column line 42C and the signal's propagation along the entire line can be negligible (e.g., relative to a similar line without signal regeneration circuit 70, and at higher fidelity). Thus, data communication rates (dependent on array 12 frame rate, array 12 size, and array substrate 10 size) are increased and data communication error rates are decreased with the use of embodiments of the present disclosure, enabling larger pixel 20 arrays 12 on larger array substrates 10 (e.g., physically larger and higher resolution displays and image sensors). Moreover, as compared to daisy-chain designs, embodiments of the present disclosure require less circuitry (e.g., no storage elements are required), can be more robust (e.g., fewer electrical connections can be required since fewer signal regeneration circuits 70 than daisy-chain storage elements are required), and can refresh array 12 more quickly.

Figure 2:
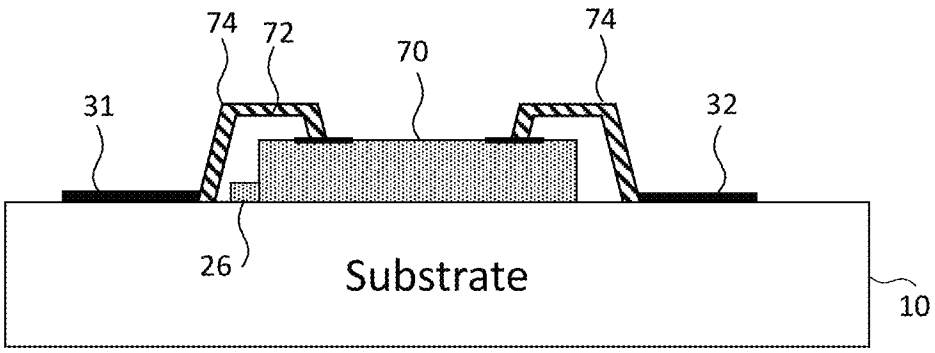
FIG. 2 is a schematic cross section of a connected signal regeneration circuit according to illustrative embodiments of the present disclosure.

As shown in FIG. 2 and according to embodiments of the present disclosure, signal regeneration circuit 70 connects to row and column first wire segments 31 and second wire segments 32 with electrodes 74 electrically insulated from semiconductor material by dielectric structures 72. According to some embodiments, signal regeneration circuit 70 regenerates the signal on first wire segment 31 and drives the regenerated signal onto second wire segments 32, or vice versa, depending, for example, on whether the signals are output signals (e.g., emitted by pixels 20) or input signals (e.g., sensed by pixels 20) in flat-panel pixel array 90. Signal regeneration circuit 70 can be an integrated circuit or a thin-film circuit and can be disposed on array substrate 10 or pixel substrate 28 by micro-transfer printing. In some such embodiments, signal regeneration circuit 70 can be a bare, unpackaged integrated circuit and, independently, can comprise or be attached to a broken tether 26 as a consequence of micro-transfer printing from a source wafer to array substrate 10 or pixel substrate 28. If pixels 20 comprise small-aperture-ratio light emitters 50 (e.g., micro-light-emitting diodes 50) or small-aperture-ratio light sensors 50, signal regeneration circuit 70 can be disposed between pixels 20 on array substrate 10 or pixel substrate 28, as shown in FIG. 1. Micro-transfer printing can micro-assemble very small (e.g., 1-200 microns in length or width, or both, and, optionally, 1-20 microns in thickness) integrated circuits so that small-aperture-ratio micro-devices can be disposed on array substrate 10, for example between pixels 20.

Figure 3:
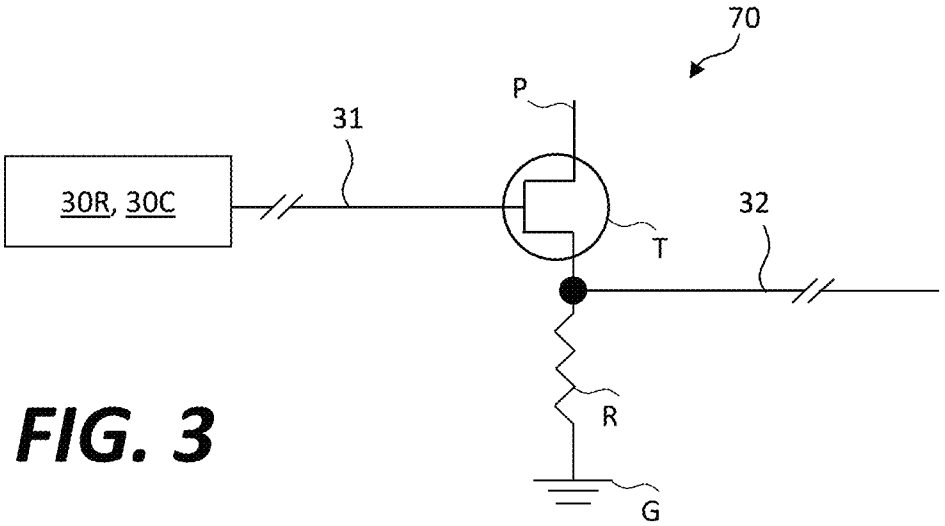
FIG. 3 is a wiring diagram of a simple signal regeneration circuit according to illustrative embodiments of the present disclosure.

FIG. 3 illustrates a simplified signal regeneration circuit 70 according to embodiments of the present disclosure. As will be apparent to those knowledgeable in electronic circuit design, a wide variety of circuits adapted to regenerate either analog or digital signals can provide signal regeneration circuit 70. As shown in the simplified schematic of FIG. 3, an input signal transmitted from a row or column controller 30R, 30C and input on first wire segment 31 controls a transistor T (e.g., connected to a transistor gate). A transistor source of transistor T can be connected to power P (e.g., $V_{dd}$) and a transistor drain can be connected to a resistor R that is connected to G (e.g., ground). An output signal is connected to resistor R and transistor T and transmitted on second wire segment 32. When the input signal is low (e.g., lower than the switching voltage of the transistor), the output row signal is connected through resistor R to ground G to provide a low (zero) output signal. When the input signal is high (e.g., greater than the gate (switching) voltage of the transistor), the transistor turns on, thereby connecting power P to resistor R so that current flows through the resistor raising the output signal voltage on second wire segment 32 to a high (e.g., one) signal, regenerating the signal. The input signal can be a column signal provided by column controller 30C transmitted on first column wire segment 31C and the output signal can be a regenerated column signal on the second column wire segment 32C. The input signal can be a row signal provided by row controller 30R transmitted on first row wire segment 31R and the output signal can be a regenerated column signal on the second row wire segment 32R. In the case in which a signal is provided from pixels 20 to a column controller 30C, the input and output signals and first and second wire segments 31, 32 can be exchanged.

In some embodiments, control signals are digital signals. In some embodiments, control signals are analog signals and signal regeneration circuit 70 is an analog amplifier.

Figure 4C:
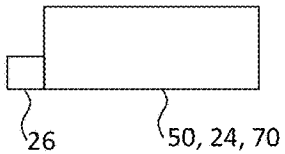
FIG. 4C is a component cross section according to illustrative embodiments of the present disclosure.
Figure 4A:
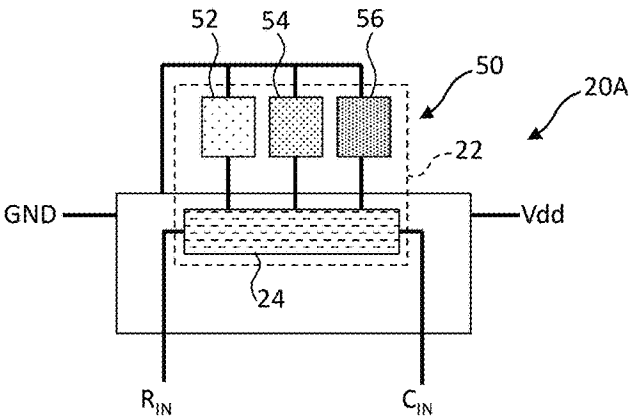
FIG. 4A is a schematic circuit diagram of a pixel.
Figure 4B:
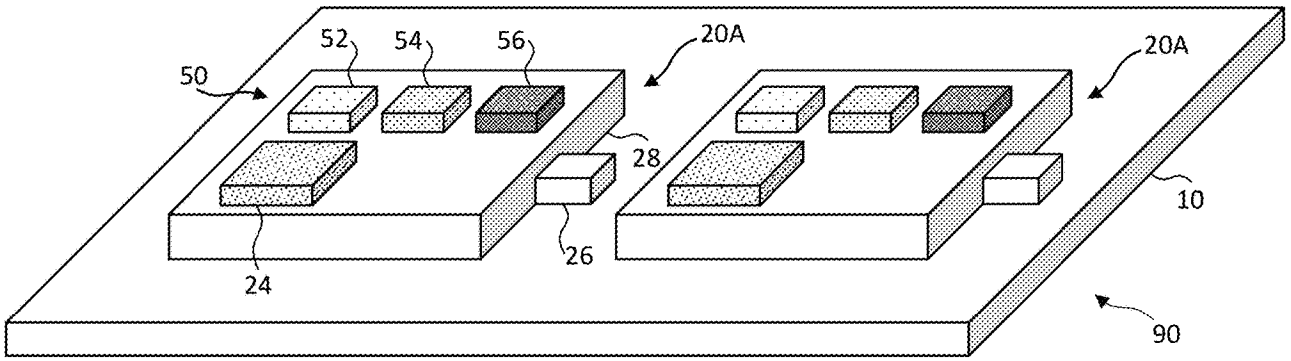
FIG. 4B is a perspective of the pixel of FIG. 4A.

FIGS. 4A-4C illustrate circuits and structures of pixel 20 according to embodiments of the present disclosure. As shown in the schematic circuit diagram of FIG. 4A, pixel 20 comprises a pixel control circuit 24 that drives one or more light emitters 50 responsive to row and column signals received on row and column lines 42R, 42C (e.g., first and second wire segments 31, 32, for each of row lines 42R and column lines 42C) (labeled $R_{IN}$ and $C_{IN}$ in FIG. 4A) or receives signals from light sensors 50 and provides row and column signals onto row and column lines 42R, 42C (e.g., first and second wire segments 31, 32, for each of row lines 42R and column lines 42C). Light emitters 50 or light sensors 50 can emit or be responsive, respectively, to different frequencies of light, for example red, green, and blue light. In some embodiments, light emitters 50 are red, green, and blue micro-light-emitting diodes that emit red light, green, light, and blue light, respectively, in a display pixel 20. The light emitters 50 or light sensors 50 and pixel control circuit 24 are comprised in a pixel light circuit 22. Pixels 20 in FIGS. 1A and 1B do not incorporate signal regeneration circuits 70 and are therefore pixels 20A, as shown in FIGS. 1A, 1B, 4A, and 4B.

As shown in FIG. 4B, light emitters 50 or light sensors 50 and pixel control circuit 24 can be disposed on pixel substrate 28. Pixel substrate 28 can be printed (e.g., micro-transfer printed) on array substrate 10 and can comprise a broken (e.g., fractured) or separated tether 26. Similarly, as shown in FIG. 4C, any one of light emitters 50 or light sensors 50, pixel control circuit 24, or signal regeneration circuit 70 can be printed (e.g., micro-transfer printed) onto pixel substrate 28 or array substrate 10 and can therefore comprise or be attached to broken (e.g., fractured) or separated tethers 26 (not shown in FIG. 4B) as a consequence of micro-transfer printing from a corresponding source wafer.

According to some embodiments and as illustrated in FIGS. 1A and 1B, a physically separate signal regeneration circuit 70 is disposed on array substrate 10 for each pixel row 40R or pixel column 40C of pixels 20 in array 12. Each signal regeneration circuit 70 can be disposed in a separate integrated circuit, for example an unpackaged bare die printed (e.g., micro-transfer printed) onto array substrate 10 that has, for example four connections, one for power P, one for ground G, one for a connection to first wire segment 31, and one for a connection to second wire segment 32 (e.g., as shown in FIGS. 3 and 4A). Such small circuits and dies can take relatively little area on array substrate 10. Such die can be transfer printed in parallel over array substrate 10, reducing assembly costs.

Figure 5:
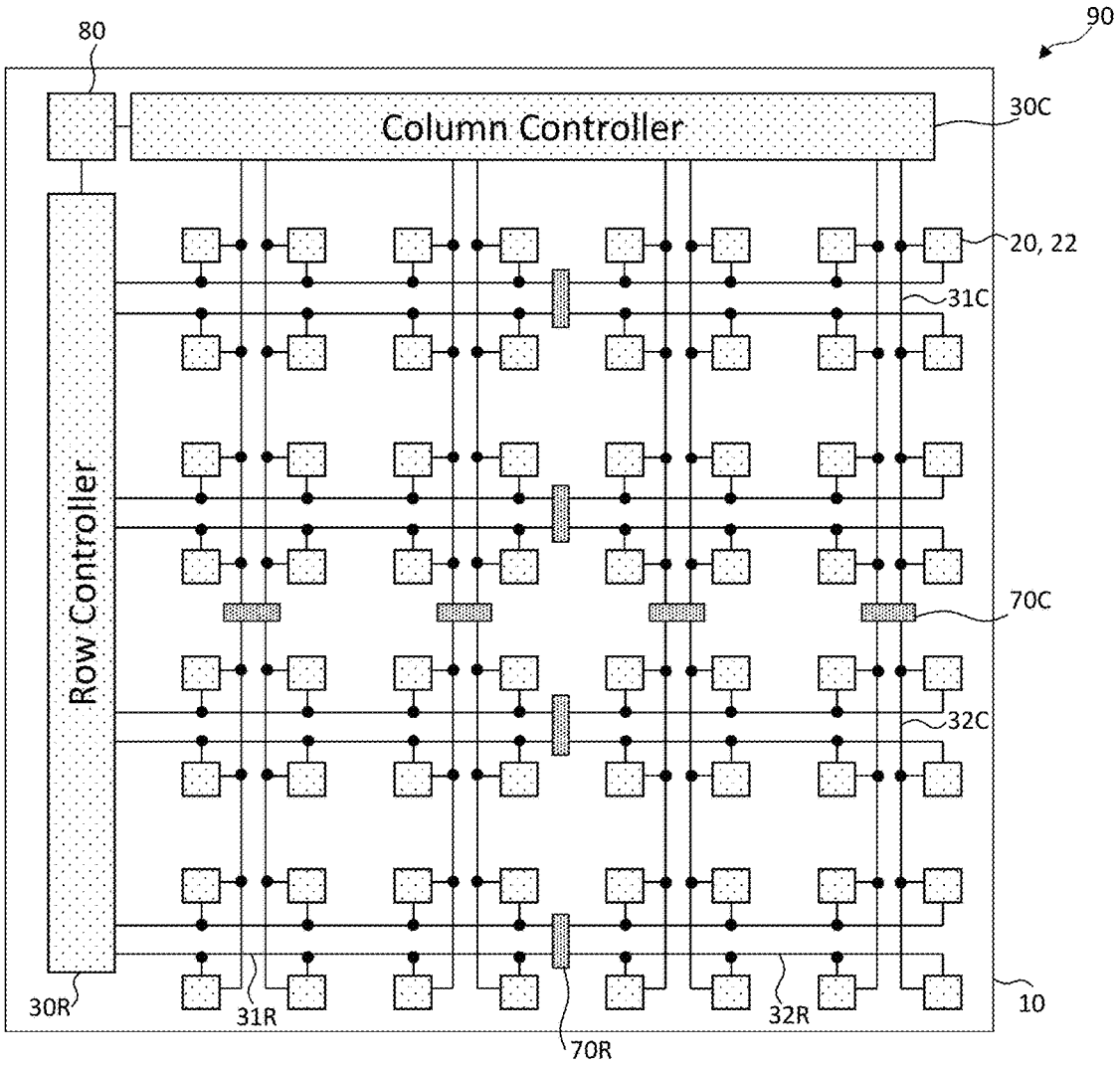
FIG. 5 is a schematic diagram of a display having row and column paired signal regeneration circuits according to illustrative embodiments of the present disclosure.

As shown in FIG. 5 and in some embodiments of the present disclosure, each signal regeneration die can comprise two signal regeneration circuits 70 that regenerate row or column signals on adjacent row lines 42R or column lines 42C. In some embodiments of a flat-panel pixel array 90 with a small aperture ratio, two row or column lines 42R, 42C can be routed between two adjacent pixel rows 40R or pixel columns 40C. The signal regeneration circuits 70 are connected as shown in FIG. 2 but, because only one power P and ground G signal is required for the die and the die includes two signal regeneration circuits 70, the number of connections for two signal lines is reduced from eight to six thereby reducing the number of possible connection failures and enhancing the robustness and reliability of flat-panel pixel array 90. Furthermore, the total size of the integrated circuit comprising the two signal regeneration circuits 70 is likely smaller than the combined size of two separate signal regeneration circuits 70 since active circuits in an integrated circuit do not reach to the edge of the integrated circuit, thereby reducing semiconductor material costs. Adjacent row lines 42R are row lines 42R for which no other row line 42R is between the adjacent row lines 42R. Similarly, adjacent column lines 42C are column lines 42C for which no other column line 42C is between the adjacent column lines 42C.

FIGS. 1A, 1B, and 5 illustrate signal regeneration circuits 70 disposed in an integrated circuit (e.g., a bare unpackaged die) disposed on array substrate 10 or pixel substrate 28 that is separate and independent of pixels 20 and physically disposed between pixels 20 in flat-panel pixel array 90. According to some embodiments of the present disclosure, pixel control circuit 24 and signal regeneration circuit 70 are disposed in separate integrated circuits, such as separate bare and unpackaged integrated circuit that can each comprise tether 26, disposed on pixel substrate 28. By forming a pixel 20 that incorporates a pixel light circuit 22 and a signal regeneration circuit 70, pixels 20 can be independently tested before assembling pixels 20 on array substrate 10, and replaced if necessary, improving flat-panel pixel array 90 yields and reducing costs.

According to some embodiments of the present disclosure, pixel control circuit 24 and signal regeneration circuit 70 are comprised (e.g., disposed) in a common integrated circuit, such as a bare and unpackaged integrated circuit that can comprise tether 26. By integrating signal regeneration circuit 70 and pixel control circuit 24 in a common integrated circuit, fewer individual integrated circuits must be micro-assembled on array substrate 10, reducing costs and construction time, since additional integrated circuits such as those shown in FIGS. 1A, 1B, and 5 are not needed. Furthermore, the total silicon area is reduced because there is no need for separate integrated circuits and the total number of I/O pins and connections is reduced since separate power, ground, and signal inputs are already incorporated in pixel control circuit 24. As noted above, separate signal regeneration circuits 70 require an additional four pins per circuit (see, for example, FIGS. 3 and 4A) or an additional six pins per pair of circuits (for example, as in FIG. 5). In some embodiments, if signal regeneration circuit 70 and pixel control circuit 24 are comprised (e.g., disposed) in a common integrated circuit only one additional I/O pin, the signal output, is required, reducing the number of connections, improving reliability, and reducing assembly costs.

Figure 6:
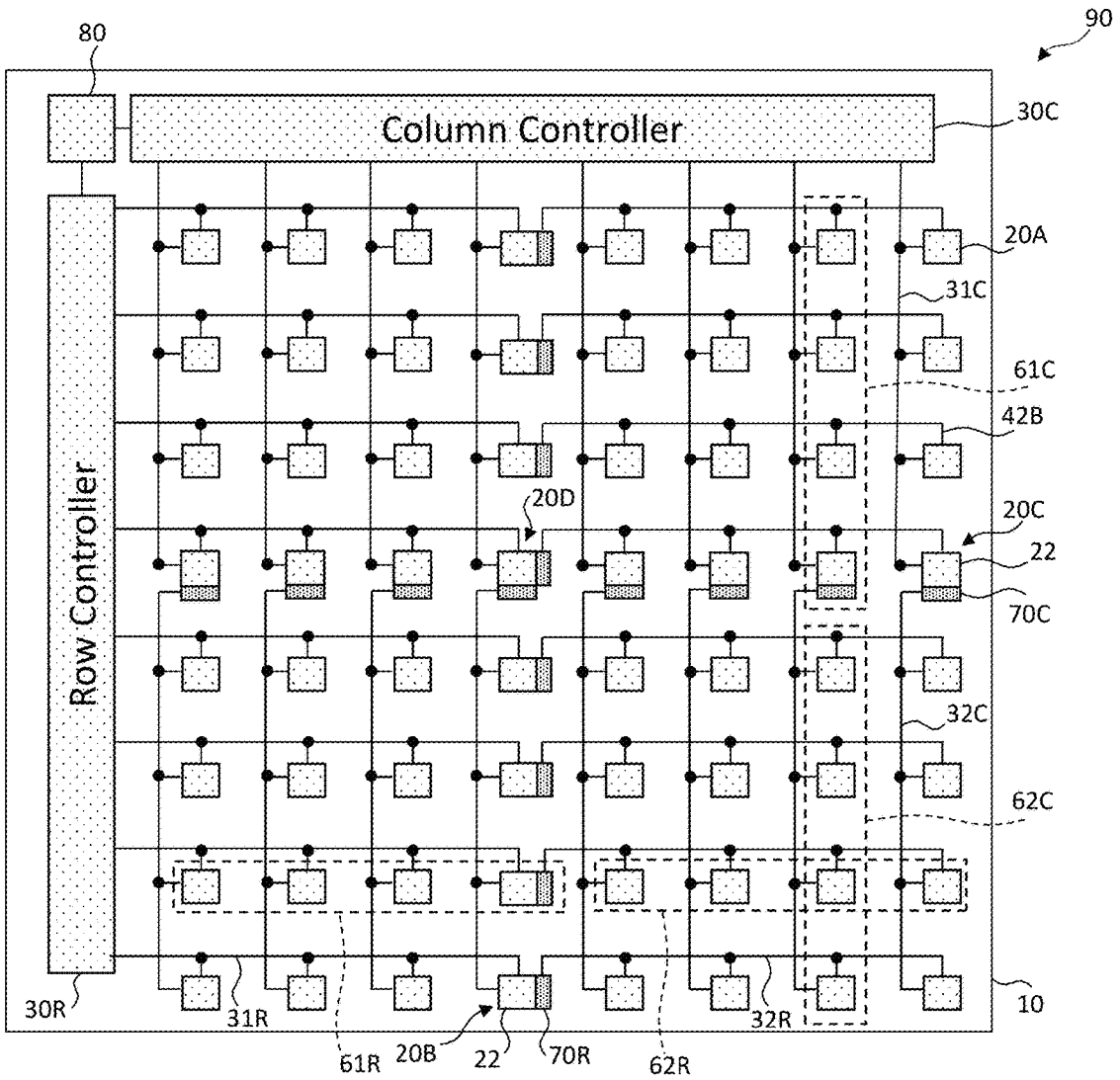
FIG. 6 is a schematic diagram of a display having pixels incorporating one or more signal regeneration circuits according to illustrative embodiments of the present disclosure.
Figure 8B:
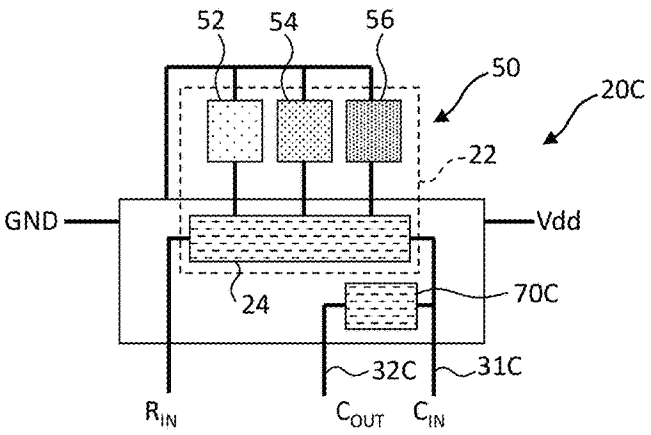
FIG. 8B is a schematic diagram of a pixel incorporating a column signal regeneration circuit.
Figure 8A:
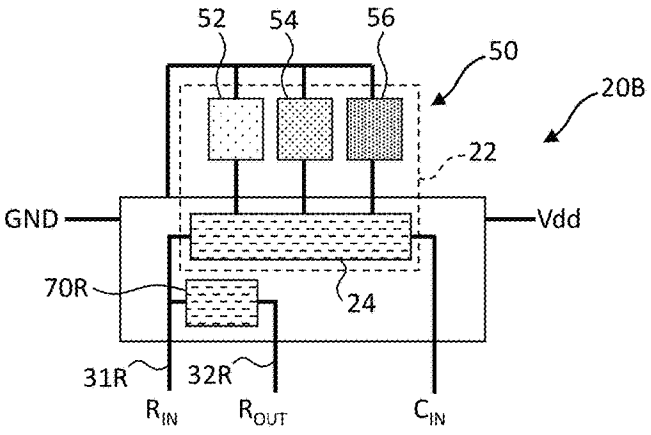
FIG. 8A is a schematic diagram of a pixel incorporating a row signal regeneration circuit.

According to embodiments of the present disclosure and as illustrated in FIGS. 6, 8A, and 8B, pixels 20 that regenerate signals each have a pixel control circuit 24 and a signal regeneration circuit 70. Such pixels 20C in a pixel row 40R each regenerate a column signal in each column line 42C of a top half (a first subset) of pixels 20 on array substrate 10 to an adjacent column line 42C on a bottom half (a second subset) of pixels 20 on array substrate 10. Likewise, such pixels 20B in a pixel column 40C each regenerate a row signal in each row line 42R of a left half (a first subset) of pixels 20 on array substrate 10 to an adjacent row line 42R on a right half (a second subset) of pixels 20 on array substrate 10. Where pixel rows 40R having column signal regeneration circuits 70C and pixel columns 40C having row signal regeneration circuits 70R intersect, the intersection pixel 20 (pixel 20D) comprises both row and column regeneration circuit 70R, 70C, a shown in FIG. 8C. The regenerated signals can transmit data at a higher data rate and with fewer errors.

Figure 7:
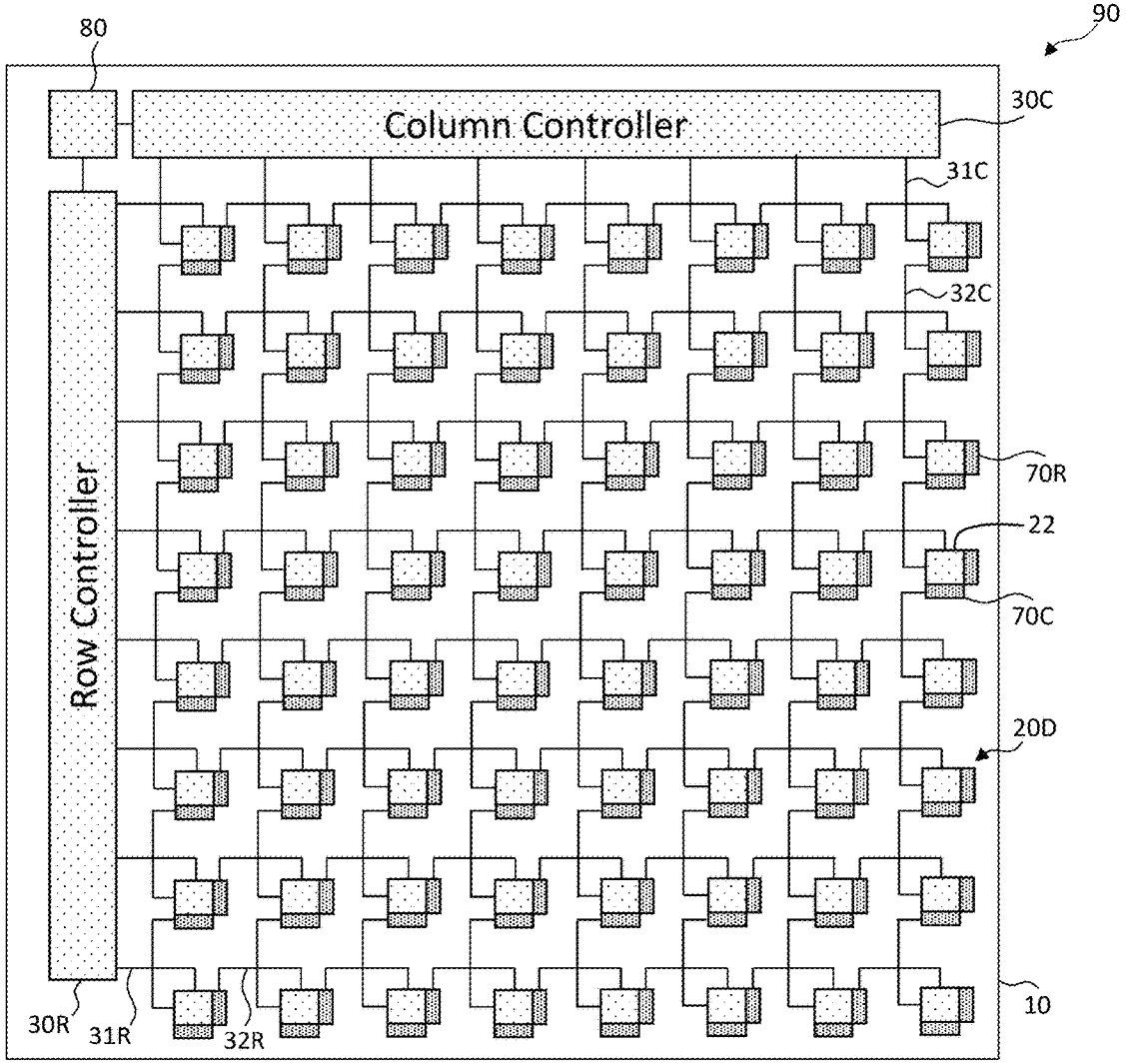
FIG. 7 is a schematic diagram of a display having pixels incorporating two signal regeneration circuits according to illustrative embodiments of the present disclosure.

FIG. 6 illustrates an array 12 of pixels 20 divided into first and second subsets. As noted with respect to FIG. 1B, array 12 of pixels 20 can be divided into more than two subsets, for example, three, four, five, six, seven, eight, nine, ten, or more subsets in each of a row and column dimension (independently). The choice of number of subsets for rows and/or columns can be made depending on the size of array substrate 10. The size of array 12 and can be, but is not necessarily, the same in the row and the column dimensions. The size of array substrate 10, the size of array 12, and the design of column and row lines 42C, 42R (e.g., material, size, spacing) can determine the transmission line characteristics of column and row lines 42C, 42R and hence the number of pixel 20 subsets necessary to enable a particular data rate (or vice versa) given controllers 30 (e.g., their number and/or architecture) and the size of array substrate 10. At one extreme example, only one row and column line 42R, 42C is used (and therefore no signal regeneration circuits 70). At the other extreme, according to some embodiments of the present disclosure and as illustrated in FIG. 7, every pixel 20 comprises, or is electrically connected to, a corresponding row signal regeneration circuit 70R, a column signal regeneration circuit 70C, or both (as shown in FIG. 7 with pixels 20D). In some such embodiments, each subset comprises only one row or column of pixels 20. The remainder of pixel light circuit 22 of pixel 20D is the same as for pixels 20A, 20B, and 20C.

Figure 8C:
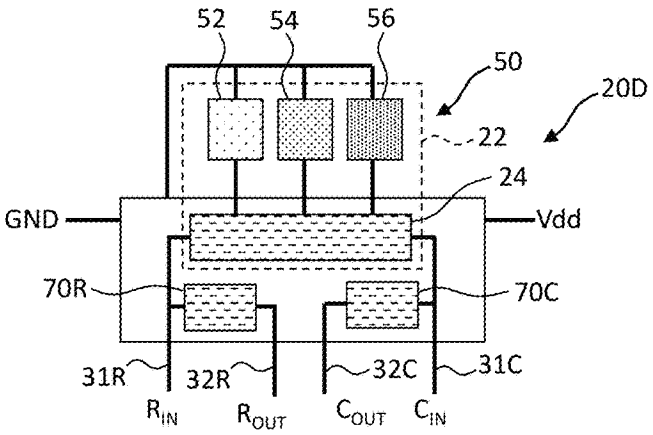
FIG. 8C is a schematic diagram of a pixel incorporating a row signal regeneration circuit and a column signal regeneration circuit, according to illustrative embodiments of the present disclosure.

FIGS. 4A and 4B illustrate pixels 20A with no signal regeneration circuit 70. FIG. 8A is a schematic diagram of pixels 20B with row signal regeneration circuits 70R in a pixel column 40C that regenerates row signals by inputting a row signal ($R_{IN}$) from the first row subset 61R on first row wire segment 31R and outputting a regenerated row signal ($R_{OUT}$) to the second row wire segment 32R of the second row subset 62R. FIG. 8B is a schematic diagram of pixels 20C with column signal regeneration circuits 70C in a pixel row 40R that regenerates column signals by inputting a column signal ($C_{IN}$) from the first column subset 61C on first column wire segment 31C and outputting a regenerated column signal ($C_{OUT}$) to the second column wire segment 32C of the second column subset 62C. The circuits of FIGS. 8A and 8B are functionally similar except that pixel 20B in FIG. 8A regenerates row signals and pixel 20C in FIG. 8B regenerates column signals. FIG. 8C is a schematic diagram of pixels 20D with row signal regeneration circuits 70R and column signal regenerating circuits 70C performing the functions of both pixels 20A and 20B together. In all four cases (e.g., pixels 20A, 20B, 20C, and 20D), pixel control circuit 24 inputs both row and column signals to control light emitters 50 or light sensors 50 (e.g., red-light-emitting diode 52, green-light-emitting diode 54, and blue-light-emitting diode 56).

In embodiments such as those of FIG. 6, different pixels 20A, 20B, 20C, and 20D can be used for the non-regenerating pixels 20, for the row regenerating pixels 20, for the column regenerating pixels 20, and for the intersecting row and column regenerating pixels 20. The different pixels 20A, 20B, 20C, and 20D can be micro-transfer printed from corresponding different source wafers. However, it is possible to reduce the number of different source wafers by transferring either pixels 20B or 20C in place of pixels 20A and not connecting the unneeded output wire in pixel 20 locations of pixels 20A. For example, there can be a different spatial arrangement of contact pads, a different number of contact pads, or both, on array substrate 10 such that pixels 20 are electrically connected differently at print. The additional semiconductor material used for pixels 20B or 20C compared to that of pixels 20A can be negligible. Furthermore, in some embodiments, it is possible to reduce the number of different source wafers by transferring pixels 20D in place of pixels 20A and not connecting the unneeded output wire in pixel 20 locations of pixels 20A, 20B, and 20C. The additional semiconductor material used for pixels 20D compared to that of pixels 20A, 20B, or 20C can be negligible. Thus, in some embodiments only a single source wafer and micro-assembly process can be used for all of pixels 20 for embodiments in accordance with any of FIGS. 1A, 1B, 6, and 7.

As noted with respect to FIG. 1B, the embodiments of FIG. 6 can comprise multiple pixel rows 40R or pixel columns 40C of pixels 20B, 20C comprising row and column signal regeneration circuits 70R, 70C, e.g., more than two pixel array 12 subsets can be used in either or both of the column and row directions.

Figure 9A:
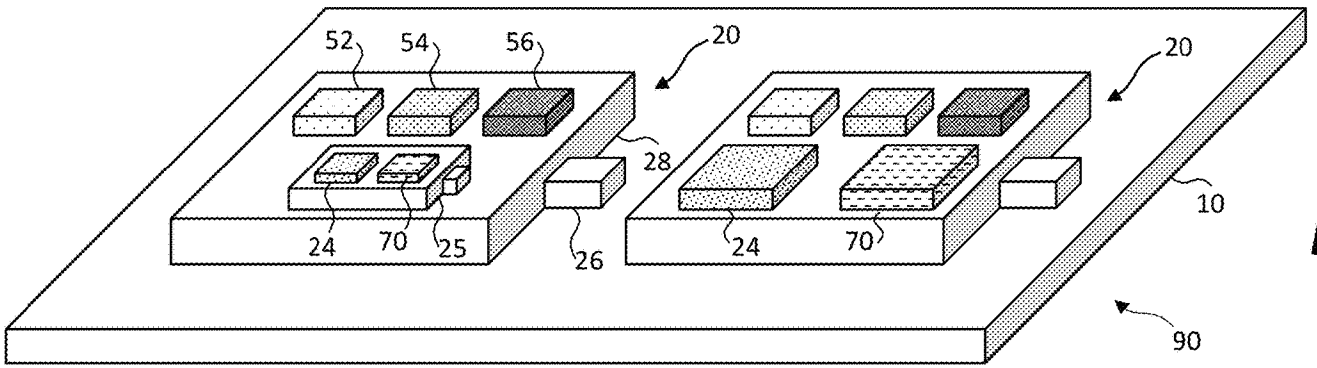
FIG. 9A is a perspective of (i) a pixel having a pixel control circuit and a signal regeneration circuit both non-native to a pixel controller substrate disposed on and non-native to a pixel substrate that is non-native to and disposed on a display substrate and (ii) a pixel having a separate pixel control circuit and signal regeneration circuit both disposed on and non-native to a pixel substrate non-native to and disposed on a display substrate, according to illustrative embodiments of the present disclosure.

Pixels 20A, 20B, 20C, and 20D can be implemented in a variety of embodiments according to the present disclosure. In embodiments such as those illustrated in FIGS. 9A and 9B, pixel 20 comprises pixel substrate 28 on which is disposed light emitters 50 or light sensors 50 (e.g., red-light-emitting diode 52, green-light-emitting diode 54, and blue-light-emitting diode 56), pixel control circuit 24 and signal regeneration circuit 70. Pixel control circuit 24 is responsive to row and column signals and light emitters 50 or light sensors 50. Light emitters 50 or light sensors 50 can be disposed on pixel substrate 28 by micro-transfer printing and can each comprise a different broken or separated tether 26 (not shown in FIG. 9A, see FIG. 4C) and are non-native to pixel substrate 28 (e.g., have a separate and independent substrate from pixel substrate 28 and array substrate 10). As illustrated in FIG. 9A, pixel control circuit 24 and signal regeneration circuit 70 are separate integrated circuits, comprising substrates separate and independent from each other and are non-native to each other, pixel substrate 28, and array substrate 10. Pixel control circuit 24 and signal regeneration circuit 70 can each be transferred printed from corresponding source wafers (or the same source wafer if the different circuits are formed on the same source wafer) to control pixel substrate 25 (let side) or pixel substrate 28 (right side), for example with micro-transfer printing that can, in some embodiments, result in a broken (e.g., fractured) or separated tether 26 attached to each of pixel control circuit 24 and signal regeneration circuit 70 (not shown). Pixel substrate 28 can be transferred, e.g., micro-transfer printed, to array substrate 10, can have a broken (e.g., fractured) or separated tether 26, and can be non-native to array substrate 10 (e.g., because it has been micro-transfer printed to array substrate 10).

Figure 9B:
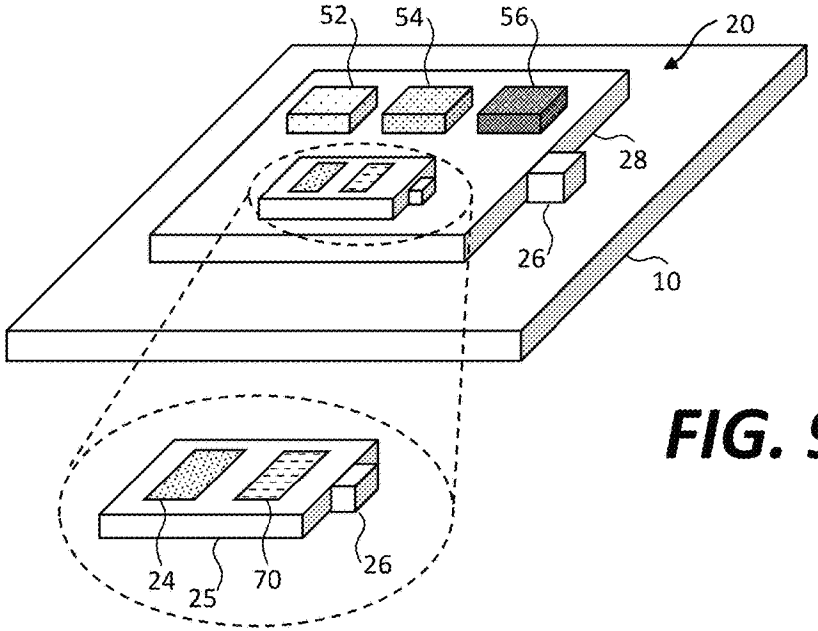
FIG. 9B is a schematic diagram of a pixel having a pixel control circuit and a signal regeneration circuit native to a pixel controller substrate disposed on and non-native to a pixel substrate that is non-native to a display or image sensor substrate, according to illustrative embodiments of the present disclosure.

In embodiments such as those illustrated in FIG. 9B, pixel 20 comprises pixel substrate 28 on which is disposed light emitters 50 or light sensors 50 (e.g., red-light-emitting diode 52, green-light-emitting diode 54, and blue-light-emitting diode 56), pixel control circuit 24 and signal regeneration circuit 70. Pixel control circuit 24 is responsive to row and column signals and light emitters 50 or light sensors 50. Light emitters 50 or light sensors 50 can be disposed on pixel substrate 28 by micro-transfer printing and can each comprise a different broken (e.g., fractured) or separated tether 26 (not shown in FIG. 9B, see FIG. 4C) and are non-native to pixel substrate 28. Pixel control circuit 24 and signal regeneration circuit 70 are formed in or on and are native to a pixel controller substrate 25 (e.g., a semiconductor substrate). Pixel controller substrate 25 with pixel control circuit 24 and signal regeneration circuit 70 can be micro-transfer printed from a corresponding source wafer to pixel substrate 28, for example with micro-transfer printing that can, in some embodiments, result in a broken (e.g., fractured) or separated tether 26 attached to or a part of pixel controller substrate 25. Pixel control circuit 24 and signal regeneration circuit 70 are native to pixel controller substrate 25 and pixel controller substrate 25 is non-native to pixel substrate 28. Pixel substrate 28 can be transferred, e.g., micro-transfer printed, to array substrate 10, can have a broken (e.g., fractured) or separated tether 26, and can be non-native to array substrate 10 (e.g., because it has been micro-transfer printed to array substrate 10).

Figure 9C:
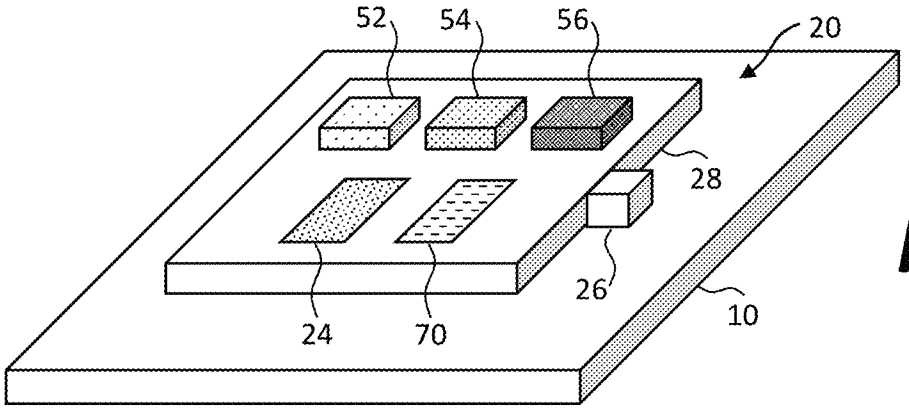
FIG. 9C is a schematic diagram of a pixel having a pixel control circuit and a signal regeneration circuit native to a pixel substrate disposed on and non-native to a display or image sensor substrate, according to illustrative embodiments of the present disclosure.
Figure 9E:
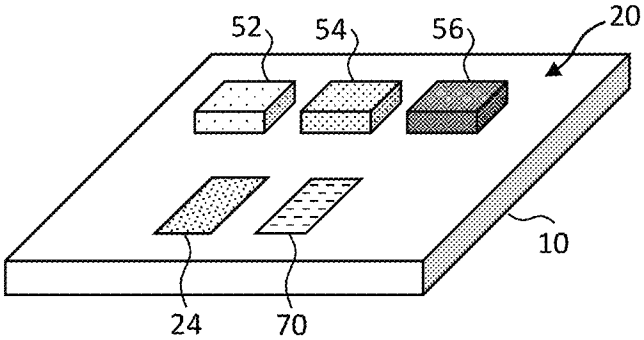
FIG. 9E is a schematic diagram of a pixel having a pixel control circuit and a signal regeneration circuit disposed on and native to a display or image sensor substrate, according to illustrative embodiments of the present disclosure.
Figure 9D:
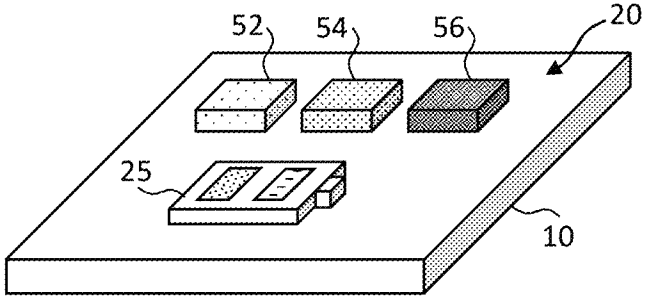
FIG. 9D is a schematic diagram of a pixel having a pixel control circuit and a signal regeneration circuit disposed on and native to a pixel controller substrate non-native to and disposed on a display or image sensor substrate, according to illustrative embodiments of the present disclosure.

In some embodiments of the present disclosure and as shown in FIG. 9C, light emitters 50 or light sensors 50 (e.g., red-light-emitting diode 52, green-light-emitting diode 54, and blue-light-emitting diode 56), are disposed directly on pixel substrate 28. Pixel control circuit 24 and signal regeneration circuit 70 are native to and disposed directly on pixel substrate 28. Pixel substrate 28 can be a semiconductor substrate, for example a silicon substrate with CMOS circuits and is disposed on and non-native to array substrate 10. In some embodiments of the present disclosure and as shown in FIG. 9D, light emitters 50 or light sensors 50 (e.g., red-light-emitting diode 52, green-light-emitting diode 54, and blue-light-emitting diode 56), are disposed directly on array substrate 10, as is pixel controller substrate 25 with pixel control circuit 24 and signal regeneration circuit 70, without any intervening pixel substrate 28. As in FIG. 9B, pixel control circuit 24 and signal regeneration circuit 70 are native to pixel controller substrate 25 and all of light emitters 50 or light sensors 50 and pixel controller substrate 25 are non-native to array substrate 10. In some embodiments of the present disclosure and as shown in FIG. 9E, light emitters 50 or light sensors 50 (e.g., red-light-emitting diode 52, green-light-emitting diode 54, and blue-light-emitting diode 56), are disposed directly on array substrate 10, as in FIG. 9B, and are non-native to array substrate 10. However, pixel control circuit 24 and signal regeneration circuit 70 are formed in or on and are native to array substrate 10. If array substrate 10 is a semiconductor array substrate 10, e.g., silicon, pixel control circuit 24 and signal regeneration circuit 70 can be circuits made in the semiconductor material of array substrate 10. If array substrate 10 is not a semiconductor, e.g., glass, polymer, or ceramic, array substrate 10 can be coated with a thin film of semiconductor material and pixel control circuit 24 and signal regeneration circuit 70 can be made in the thin film of semiconductor material, e.g., as is commonly done with flat-panel liquid crystal or organic light-emitting diode displays.

Array substrate 10 can be any useful substrate on which array 12 of pixels 20, row lines 42R, and column lines 42C (e.g., first and second wire segments 31, 32) can be suitably disposed, for example glass, plastic, resin, fiberglass, semiconductor, ceramic, quartz, sapphire, or other substrates found in the display or integrated circuit industries. Array substrate 10 can be flexible or rigid and can be substantially flat. Column lines 42C and row lines 42R (e.g., first and second wire segments 31, 32) can be wires (e.g., photolithographically defined electrical conductors such as metal lines) disposed on array substrate 10 that conduct electrical current from column and row controllers 30C, 30R, respectively, to pixels 20 in the first row or column subsets 61R, 61C of pixels 20 or from row and column signal regeneration circuits 70C, 70R, respectively, to pixels 20 in the second row or column subsets 62R, 62C of pixels 20 or any additional subsets of pixels 20, or vice versa. In a matrix-addressed flat-panel pixel array 90, column lines 42C can conduct column signals such as column data signals and row lines 42R can conduct row signals such as timing or control signals, for example row-select signals. Column and row designations are arbitrary and can be interchanged without affecting the embodiments described in the present disclosure.

Column controller 30C can be, for example, an integrated circuit that provides control, timing (e.g., clocks) or data signals (e.g., column-data signals) through column lines 42C to pixel columns 40C of pixels 20 to enable pixels 20 to control or respond to light in flat-panel display 90. Each column line 42C can be electrically separate and optionally independently controlled from every other column line 42C by column controller 30C. Column controller 30C can comprise a single integrated circuit or can comprise multiple integrated circuits, e.g., electrically connected integrated circuits. The integrated circuit(s) can be micro-transfer printed as unpackaged dies and can comprise broken (e.g., fractured) or separated tether(s) 26.

Row controller 30R can be, for example, an integrated circuit that provides control signals (e.g., row-select signals) and/or timing signals (e.g., clocks or timing signals such as pulse-width modulation (PWM) signals) through row lines 42R to pixel rows 40R of pixels 20 to cause pixels 20 to control or respond to light in flat-panel display 90. Each row line 42R can be electrically separate and optionally independently controlled from every other row line 42R by row controller 30R. Row controller 30R can comprise a single integrated circuit or can comprise multiple integrated circuits, e.g., electrically connected integrated circuits. The integrated circuit(s) can be micro-transfer printed as unpackaged dies and can comprise broken (e.g., fractured) or separated tether(s) 26.

Array 12 of pixels 20 can be a completely regular array 12 (e.g., as shown in FIG. 1A) or can have pixel rows 40R or pixel columns 40C of pixels 20 that are offset from each other, so that pixel rows 40R or pixel columns 40C of pixels 20 are not disposed in a straight line and can, for example, form a zigzag line (not shown in the Figures) or, as another example, have non-uniform spacing(s).

Pixels 20 can be active- or passive-matrix pixels 20, can be analog or digital, and can comprise one or more light-controlling or light-responsive elements. Pixels 20 can comprise micro-light-emitting diodes 50, e.g., inorganic light-emitting diodes 50 such as horizontal inorganic light-emitting diodes 50 or vertical inorganic light-emitting diodes 50 (not shown in the Figures). Inorganic light-emitting diodes 50 can have a small area, for example having a length and a width each no greater than 20 microns, no greater than 50 microns, no greater than 100 microns, or no greater than 200 microns. Such small light emitters 50 leave additional area on array substrate 10 for more or larger wires or additional functional elements such as signal regeneration circuits 70.

As shown in FIGS. 4A, 4B, 8A-8C, and 9A-9E, pixels 20 can comprise a pixel control circuit 24. Pixels 20 can comprise a red-light-emitting diode 52 that emits red light, a green-light-emitting diode 54 that emits green light, and a blue-light-emitting diode 56 that emits blue light (collectively light-emitting diodes 50 or LEDs 50) under the control of pixel control circuit 24. In certain embodiments, light emitters 50 that emit light of other color(s) are included in pixel 20, additionally or alternatively, such as a yellow light-emitting diode. Light-emitting diodes 50 can be mini-LEDs 50 (e.g., having a largest dimension no greater than 500 microns) or micro-LEDs 50 (e.g., having a largest dimension of no greater than 100 microns). Pixels 20 can emit one color of light or white light (e.g., as in a black-and-white display) or multiple colors of light (e.g., red, green, and blue light as in a color display). Pixels 20 can comprise multiple elements (e.g., pixel control circuit 24 and one or more LEDs 50) disposed and electrically connected directly on array substrate 10 or can comprise multiple elements disposed and electrically connected on pixel substrate 28 separate and independent from array substrate 10 with pixel substrate 28 disposed on array substrate 10 (e.g., by micro-transfer printing). Any one or more of pixel control circuit 24 and LEDs 50 can be micro-transfer printed onto array substrate 10 or onto pixel substrate 28. If pixel control circuit 24 and LED(s) 50 are disposed on separate and independent pixel substrate 28 to form pixel 20, pixel 20 (with pixel substrate 28) can be micro-transfer printed from a pixel source substrate onto array substrate 10 and electrically connected to control signal wires (e.g., row lines 42R comprising at least first and second row wire segments 31R, 32R, column lines 42C comprising at least first and second column wire segments 31C, 32C, power, and ground signal wires) on array substrate 10. Micro-transfer printed devices or structures (e.g., LEDs 50, pixel control circuit 24, or pixel 20) can comprise broken (e.g., fractured) or separated tether(s) 26 as a consequence of micro-transfer printing from a source to a target substrate such as pixel substrate 28 or substrate 10.

According to some embodiments of the present disclosure, an active-matrix pixel control circuit 24 sends or receives column signals to or from column controller 30C through column line 42C and row signals from row controller 30R through row line 42R. When a pixel 20 is selected by row line 42R, data received from or sent to column line 42C is stored in a pixel memory in pixel control circuit 24 and, using a pixel timing circuit in pixel control circuit 24, controls light-emitting diodes 50 to emit or respond to light. U.S. Patent Publication No. 2018/019747 describes circuits useful in such applications and its contents are entirely incorporated by reference herein. The pixel memory can be a digital memory (e.g., a static random access memory (SRAM) or shift register storing digital values representing the desired brightness of each light-emitting diode 50 or an amount of light received captured by light sensor 50) or an analog memory (e.g., one or more capacitors storing a charge representing the desired brightness of each light-emitting diode 50 or an amount of light received captured by light sensor 50). Pixel control circuits 24 can be thin-film circuits. According to some embodiments of the present disclosure, pixel control circuits 24 or signal regeneration circuits 70 comprise integrated circuits formed in a crystalline semiconductor (e.g., silicon) pixel controller substrate 25 that are transferred from a native source wafer to non-native array substrate 10 or to a non-native pixel substrate 28, for example by micro-transfer printing. Pixel control circuits 24 and signal regeneration circuits 70 can be disposed in and native to a common integrated circuit. As a consequence of micro-transfer printing, pixel control circuit 24 or signal regeneration circuit 70 can comprise a broken (e.g., fractured) or separated tether 26. Such crystalline circuits have much better performance and a smaller size than thin-film semiconductor circuits.

According to some embodiments of the present disclosure, pixels 20 comprise inorganic micro-light-emitting diodes 50 that have a length and a width over array substrate 10 or pixel substrate 28 that is no greater than 100 microns (e.g., no greater than 50 microns, no greater than 20 microns, no greater than 15 microns, no greater than 12 microns, no greater than 10 microns, no greater than 8 microns, no greater than 5 microns, or no greater than 3 microns). Such relatively small light emitters 50 disposed on a relatively large array substrate 10 (for example a laptop display, a monitor display, or a television display) take up relatively little area on array substrate 10 so that the fill factor of LEDs 50 on array substrate 10 (e.g., the aperture ratio or the ratio of the sum of the areas of LEDs 50 over array substrate 10 to the convex hull area of array substrate 10 that includes LEDs 50 or minimum rectangular area of pixel 20 array 12) is no greater than 30% (e.g., no greater than 20%, no greater than 10%, no greater than 5%, no greater than 1%, no greater than 0.5%, no greater than 0.1%, no greater than 0.05%, or no greater than 0.01%). For example, an 8K display (having a display pixel array 12 bounding 8192 by 4096 display pixels 20) over a 2-meter diagonal 9:16 display with micro-LEDs 50 having a 15-micron length and 8-micron width has a fill factor of much less than 1%. An 8K display having 40-micron by 40-micron pixels 20 can have a fill factor of about 3%. According to embodiments of the present disclosure, because the display area fill factor of the micro-LEDs 50 can be so small, signal regeneration functions can be integrated into pixels 20 even if pixels 20 are consequently larger. As discussed in U.S. Pat. No. 9,991,163, referenced above, a display substrate 10 having such a small fill factor can use the remaining area of display substrate 10 to provide other functionality.

According to some embodiments of the present disclosure, at least a portion of the remaining area not occupied by light emitters 50 or light sensors 50 is used to provide signal regeneration circuits 70. Higher-frequency signals can be transmitted over larger areas with an improved signal-to-noise ratio and are therefore more reliable and robust. Moreover, the remaining area can also be used to form larger or wider row or column lines 42R, 42C having reduced resistance. Thus, according to some embodiments of the present disclosure, larger flat-panel pixel arrays 90 can be controlled more easily with fewer communication errors and improved power and ground distribution and with fewer integrated circuits.

In contrast to embodiments of the present disclosure, existing prior-art flat-panel displays have a desirably large fill factor. For example, the lifetime of OLED displays is increased with a larger fill factor because such a larger fill factor reduces current density and improves organic material lifetimes. Similarly, liquid-crystal displays (LCDs) have a desirably large fill factor to reduce the necessary brightness of the backlight (because larger pixels transmit more light), improving the backlight lifetime and display power efficiency. Thus, prior displays cannot reduce control frequency and improve control line conductivity because there is no space on their display substrates for additional or larger control lines or additional functional elements, such as signal regeneration circuits 70, in contrast to embodiments of the present disclosure. In some embodiments of the present disclosure, any two or more of pixels 20, column lines 42C, and row lines 42R are comprised (e.g., disposed) in a common layer on array substrate 10 and pixels 20 are not, for example, disposed over or below column lines 42C and row lines 42R. Array substrate 10 costs are reduced by disposing any two or more of pixels 20, column lines 42C, and row lines 42R in a common layer.

Figure 10A:
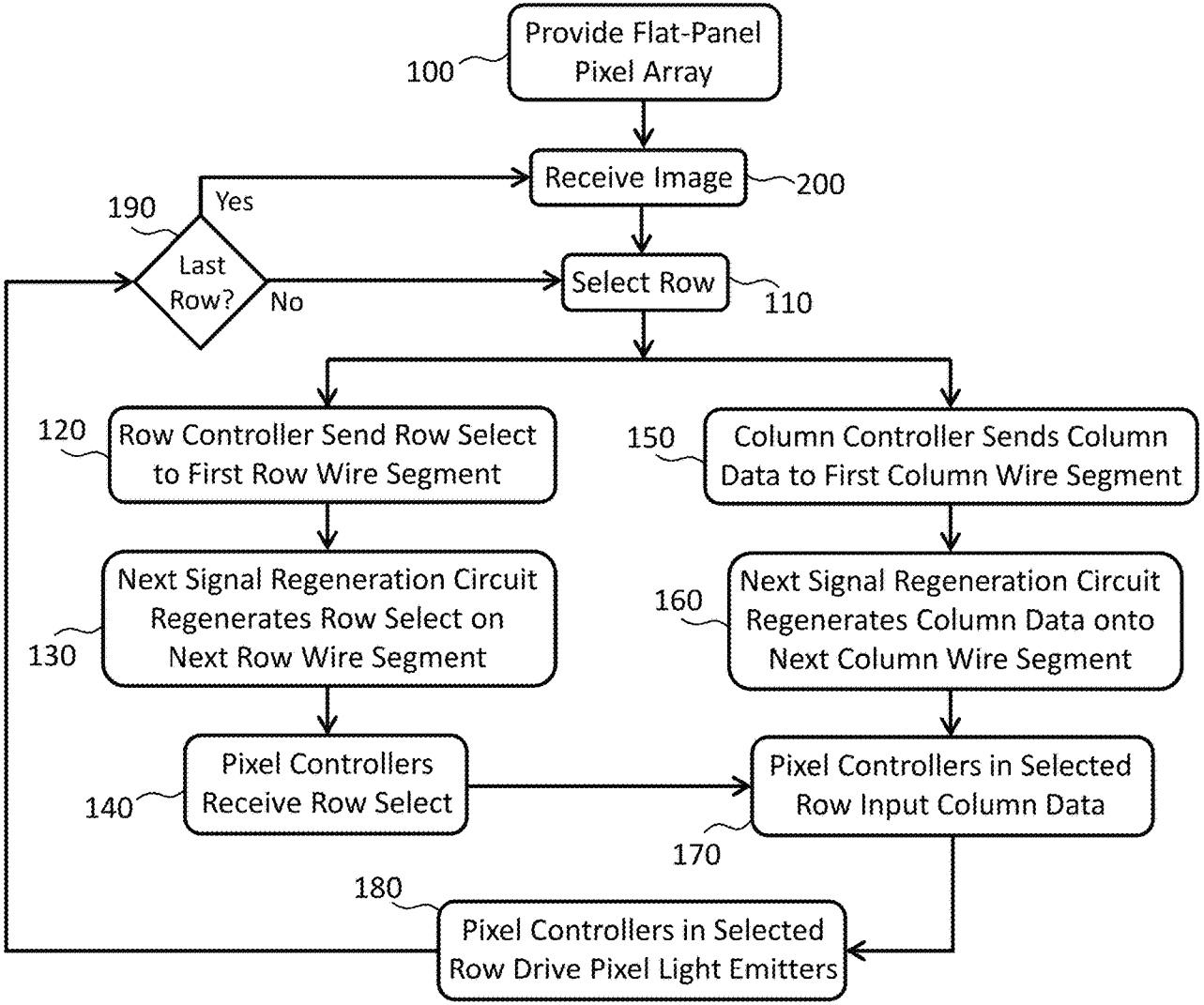
FIGS. 10A and 10B are flow diagrams illustrating methods and structures according to illustrative embodiments of the present disclosure.

According to some embodiments (e.g., display embodiments) of the present disclosure and referring to the flow diagram of FIG. 10A, a method of controlling a flat-panel pixel array 90 (e.g., a display) comprises providing flat-panel pixel array 90 in step 100, receiving an image (e.g., an image frame in a sequence of images) in step 200 and selecting a pixel row 40R (e.g., a first pixel row 40R in array 12) in step 110, for example pixel array controller 80 provides a control signal to row controller 30R. In step 120, row controller 30R provides row signals to pixel rows 40R of array 12, one of which is a row select signal to the selected pixel row 40R, on first row wire segments 31R. The row select signal is regenerated in step 130 by each row signal regeneration circuit 70R in each pixel row 40R (e.g., a zero signal to indicate that a pixel row 40R is not selected and a one signal on selected pixel row 40R) to each row wire segment (e.g., second row wire segment 32R) until all pixels 20 in every pixel row 40R receives a row signal from row controller 30R. Pixel control circuits 24 in each pixel row 40R receive their corresponding row signal in step 140. At the same time as, before, or after steps 120, 130, and 140, column controller 30C receives data from pixel array controller 80 and sends column data on first column wire segment 31C for each pixel column 40C in array 12 in step 150. The column data is regenerated in step 160 to each column wire segment (e.g., second column wire segment 32C) until every pixel 20 in every pixel column 40C receives a column signal from column controller 30C. Pixel control circuits 24 in each pixel column 40C receive their corresponding column signal in step 160. Once every pixel 20 has received both a column and a row signal, whether regenerated or not, pixel control circuits 24 respond to the column and row signals in the selected pixel row 40R to store (in an active-matrix embodiment) the column signal (e.g., column data) in step 170 and emit light corresponding to the column signal information in step 180. The rows of pixels 20 that are not selected take no action. A next pixel row 40R is then selected (e.g., the next pixel row 40R in array 12) in step 190 and the process is repeated. Once column signals have been input by every pixel control circuit 24 in every pixel row 40R, a new display image (e.g., image frame) is received by pixel array controller 80 (e.g., a display controller) in step 200, and a new image is loaded into array 12 of pixels 20 using steps 110-190.

Figure 10B:
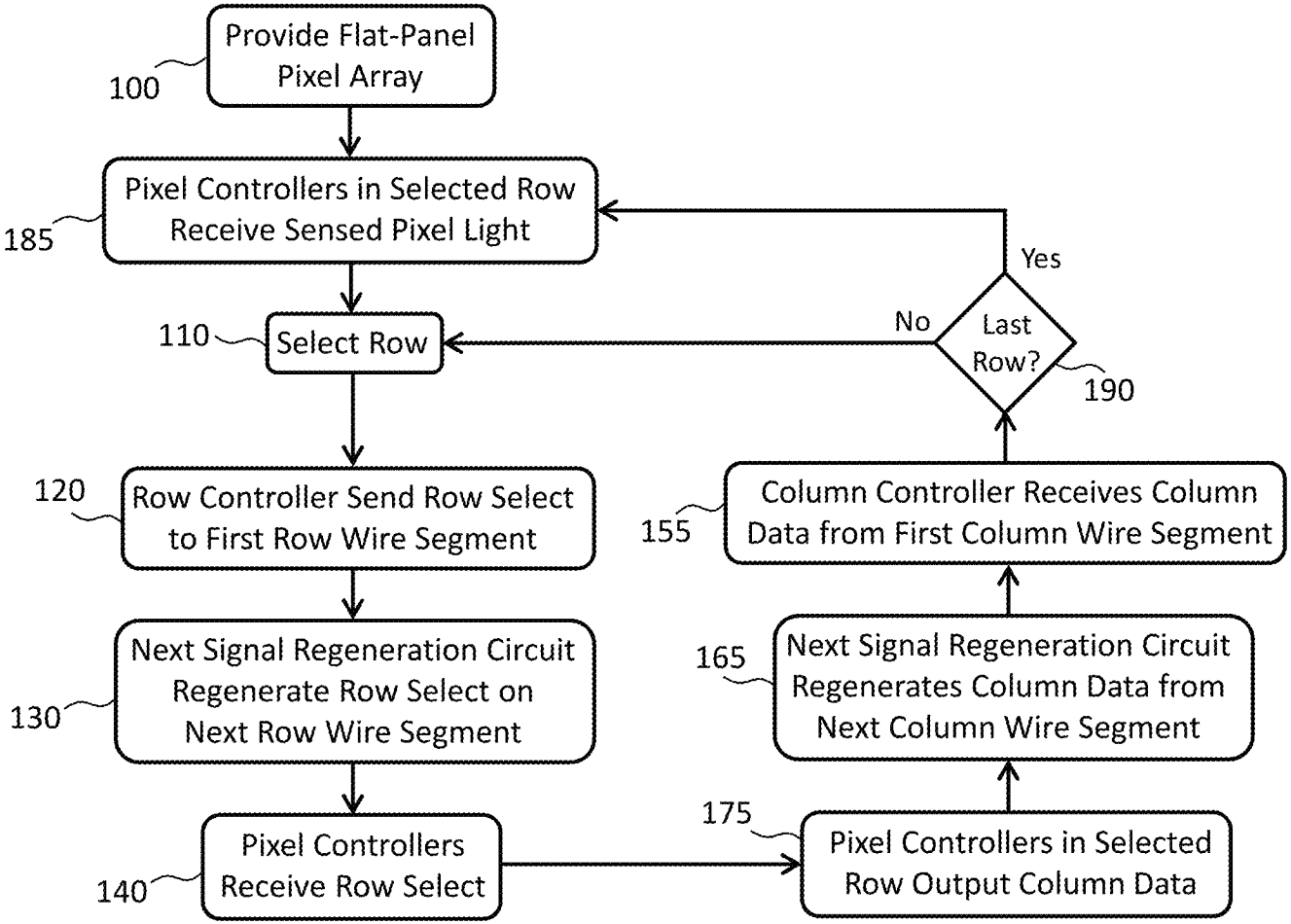

According to some embodiments (e.g., image sensor embodiments) of the present disclosure and referring to the flow diagram of FIG. 10B, a method of controlling a flat-panel pixel array 90 (e.g., an image sensor array 12) comprises providing flat-panel pixel array 90 in step 100, sensing an image in step 185 (e.g., receiving an image frame in a sequence of images) and selecting a pixel row 40R (e.g., a first pixel row 40R in array 12) in step 110, for example pixel array controller 80 provides a control signal to row controller 30R. In step 120, row controller 30R provides row signals to pixel rows 40R of array 12, one of which is a row select signal to selected pixel row 40R, on first row wire segments 31R. The row select signal is regenerated in step 130 by each row signal regeneration circuit 70R in each pixel row 40R (e.g., a zero signal to indicate that a pixel row 40R is not selected and a one signal on selected pixel row 40R) to each row wire segment (e.g., second row wire segment 32R) until all pixels 20 in every pixel row 40R receives a row signal from row controller 30R. Pixel control circuits 24 in each pixel row 40R receive their corresponding row signal in step 140. After step 140, in step 175 each selected pixel control circuit 24 in selected pixel row 40R transmits image data sensed in step 185 onto corresponding column wire segments. The column data is regenerated in step 160 to each column wire segment (e.g., first column wire segment 31C) until column controller 30C receives sensed image data for every pixel column 40C. The rows of pixels 20 that are not selected take no action. A next pixel row 40R is then selected (e.g., the next pixel row 40R in array 12) in step 190 and the process is repeated. Once column signals have been input by every pixel control circuit 24 in every pixel row 40R, a new display image (e.g., image frame) is received by pixel array controller 80 (e.g., a display controller 80) in step 185, and a new image is sensed by array 12 of pixels 20 and output using steps 110-190.

Pixels 20 and LEDs 50 can be made in multiple integrated circuits non-native to array substrate 10. The multiple integrated circuits can be micro-elements (e.g., as shown in FIG. 4C) and micro-assembled (e.g., micro-transfer printed) onto array substrate 10 or onto pixel substrate 28. The multiple integrated circuits can be small, unpackaged integrated circuits such as unpackaged dies interconnected with wires connected to contact pads on the integrated circuits, for example formed using photolithographic methods and materials. In some embodiments, the integrated circuits are made in or on a semiconductor wafer and have a semiconductor substrate. Array substrate 10 or pixel substrate 28, or both, can include glass, resin, polymer, plastic, or metal. Pixel substrate 28 can be a semiconductor substrate and one or more of pixel control circuit 24 (e.g., comprising a pixel memory, a pixel timing circuit, and an LED drive circuit) and signal regeneration circuit 70 are formed in or on pixel substrate 28 (and thus are native to pixel substrate 28, as shown in FIG. 9C). Semiconductor materials (for example doped or undoped silicon, GaAs, or GaN) and processes for making small integrated circuits are well known in the integrated circuit arts. Likewise, backplane substrates and means for interconnecting integrated circuit elements on the backplane are well known in the display and printed circuit board arts.

Micro-elements, such as LEDs 50 or circuit(s) included in pixels 20, can have an area of, for example, not more than 50 square microns, not more than 100 square microns, not more than 500 square microns, or not more than 1 square mm and can be only a few microns thick, for example, no more than 5 microns, no more than 10 microns, no more than 20 microns, or no more than 50 microns thick.

In a method according to some embodiments of the present disclosure, integrated circuits are disposed on the array substrate 10 by micro transfer printing. In some methods, integrated circuits (or portions thereof) or LEDs 50 are disposed on pixel substrate 28 to form a heterogeneous pixel 20 and pixel 20 is disposed on array substrate 10 using compound micro-assembly structures and methods, for example as described in U.S. patent application Ser. No. 14/822,868 filed Aug. 10, 2015, entitled Compound Micro Assembly Strategies and Devices. However, since pixels 20 can be larger than the integrated circuits included therein, in some methods of the present disclosure, pixels 20 are disposed on array substrate 10 using pick-and-place methods found in the printed-circuit board industry, for example using vacuum grippers. Pixels 20 can be interconnected on array substrate 10 using photolithographic methods and materials or printed circuit board methods and materials.

In certain embodiments, array substrate 10 includes material, for example glass or plastic, different from a material in an integrated-circuit substrate, for example a semiconductor material such as silicon or GaN. LEDs 50 can be formed separately on separate semiconductor substrates, assembled onto pixel substrates 28 to form pixels 20 and then the assembled units are located on the surface of array substrate 10. This arrangement has the advantage that the integrated circuits or pixels 20 can be separately tested on pixel substrate 28 and the pixel modules accepted, repaired, or discarded before pixels 20 are located on array substrate 10, thus improving yields and reducing costs.

In some embodiments of the present disclosure, providing flat-panel pixel array 90, array substrate 10, or pixels 20 can include forming conductive wires (e.g., row lines 42R and column lines 42C, e.g., first and second wire segments 31, 32) on array substrate 10 or pixel substrate 28 by using photolithographic and display substrate processing techniques, for example photolithographic processes employing metal or metal oxide deposition using evaporation or sputtering, curable resin coatings (e.g. SU8), positive or negative photo-resist coating, radiation (e.g. ultraviolet radiation) exposure through a patterned mask, and etching methods to form patterned metal structures, vias, insulating layers, and electrical interconnections. Inkjet and screen-printing deposition processes and materials can be used to form patterned conductors or other electrical elements. The electrical interconnections, or wires, can be fine interconnections, for example having a width of less than fifty microns, less than twenty microns, less than ten microns, less than five microns, less than two microns, or less than one micron. Such fine interconnections are useful for interconnecting micro-integrated circuits, for example as bare dies with contact pads and used with pixel substrates 28. Alternatively or additionally, wires can include one or more crude lithography interconnections having a width from 2 μm to 2 mm, wherein each crude lithography interconnection electrically interconnects pixels 20 on array substrate 10. For example, electrical interconnections shown in FIG. 2 (e.g., electrodes 74) can be formed with fine interconnections (e.g., relatively small high-resolution interconnections) while first and second wire segments 31, 32 as shown in FIGS. 1A, 1B are formed with crude interconnections (e.g., relatively large low-resolution interconnections).

In some embodiments, red, green, and blue LEDs 52, 54, 56 (e.g., micro-LEDs 50) are micro transfer printed to pixel substrates 28 or array substrate 10 in one or more transfers and can comprise broken (e.g., fractured) or separated tethers 26 as a consequence of micro-transfer printing. For a discussion of micro-transfer printing techniques that can be used or adapted for use in methods disclosed herein, see U.S. Pat. Nos. 8,722,458, 7,622,367 and 8,506,867, each of which is hereby incorporated by reference in its entirety. The transferred light emitters 50 or light sensors 50 are then interconnected, for example with conductive wires and optionally including connection pads and other electrical connection structures, to enable a column controller 30C or row controller 30R to electrically interact with light-emitters 50 to emit or light sensors 50 to sense, light.

In some embodiments of the present disclosure, an array 12 of pixels 20 (e.g., as in FIG. 1) can include at least 40,000, 62,500, 100,000, 500,000, one million, two million, three million, six million, eight million, or thirty-two million pixels 20, for example for a quarter VGA, VGA, HD, 4K, 5K, 8K, 10K, or 16K display or camera having various pixel densities (e.g., having at least 50, at least 75, at least 100, at least 150, at least 200, at least 300, or at least 400 pixels per inch (ppi)). In some embodiments of the present disclosure, light emitters 50 in pixels 20 can be considered integrated circuits, since they are formed in a substrate, for example a wafer substrate, or layer using integrated-circuit processes. The substrate or layer need not necessarily be silicon, for example III-V semiconductor wafers or layers can be used to form light emitters 50 using integrated-circuit processes and are considered integrated circuits (or portions thereof) in the context of this disclosure.

Generally, array substrate 10 has two opposing (e.g., smooth) sides suitable for material deposition, photolithographic processing, or micro-transfer printing of micro-LEDs 50. Array substrate 10 can have a size of a conventional display, for example a rectangle with a diagonal of a few centimeters to one or more meters. Array substrate 10 can include polymer, plastic, resin, polyimide, PEN, PET, metal, metal foil, glass, a semiconductor, or sapphire and have a transparency greater than or equal to 50%, 80%, 90%, or 95% for visible light. In some embodiments of the present disclosure, LEDs 50 or light sensors 50 emit light or sense light through array substrate 10. In some embodiments, LEDs 50 or light sensors 50 emit or sense light in a direction opposite array substrate 10. Array substrate 10 can have a thickness from 5 microns to 20 mm (e.g., 5 to 10 microns, 10 to 50 microns, 50 to 100 microns, 100 to 200 microns, 200 to 500 microns, 500 microns to 0.5 mm, 0.5 to 1 mm, 1 mm to 5 mm, 5 mm to 10 mm, or 10 mm to 20 mm) or be thicker. According to some embodiments of the present disclosure, array substrate 10 can include layers formed on an underlying structure or substrate, for example a rigid or flexible glass or plastic substrate.

In some embodiments, array substrate 10 can have a single, connected, contiguous system substrate light emitter 50 or light sensor 50 area (e.g., a convex hull) including pixels 20 that each have a functional area, e.g., a display or sensor area. The combined functional area of light emitters or light sensors 50 can be less than or equal to one-quarter of the contiguous system substrate area. In some embodiments, the combined functional areas of light emitters 50 or light sensors 50 is less than or equal to one eighth, one tenth, one twentieth, one fiftieth, one hundredth, one five-hundredth, one thousandth, one two-thousandth, or one ten-thousandth of the contiguous system substrate area. Thus, remaining area over array substrate 10 is available for larger column or row lines 42C, 42R or for additional functional elements such as signal regenerations circuits 70 that can cover no less than 5% (e.g., no less than 10%, 20%, 30%, 40%, 50%, 60% 70%, 80%, or 90%) of the area between pixels 20 in the display or sensor area.

In some embodiments of the present disclosure, light emitters 50 are inorganic micro-light-emitting diodes 50 (micro-LEDs 50), for example having light-emissive areas of less than 10, 20, 50, or 100 square microns. In some embodiments, light emitters 50 have physical dimensions that are less than 100 μm, for example having at least one of: a width from 2 to 50 μm (e.g., 2 to 5 μm, 5 to 10 μm, 10 to 20 μm, or 20 to 50 μm), a length from 2 to 50 μm (e.g., 2 to 5 μm, 5 to 10 μm, 10 to 20 μm, or 20 to 50 μm), and a height from 2 to 50 μm (e.g., 2 to 5 μm, 5 to 10 μm, 10 to 20 μm, or 20 to 50 μm). The light emitters can have a size of, for example, one square micron to 500 square microns. Such micro-LEDs 50 have the advantage of a small light-emissive area compared to their brightness as well as color purity providing highly saturated display colors and a substantially Lambertian emission providing a wide viewing angle. Such small light emitters 50 also provide additional space on array substrate 10 for additional functional elements or larger wires.

According to various embodiments, flat-panel pixel array 90 can include a variety of designs having a variety of resolutions, light emitter 50 or light sensor 50 sizes, and displays or image arrays 12 having a range of array substrate 10 areas.

Pixels 20 of flat-panel pixel array 90 can be arranged in a regular array 12 (e.g., as shown in FIG. 1) or an irregular array 12 on array substrate 10.

In some embodiments, LEDs 50 or light sensors 50 are formed in substrates or on supports separate from array substrate 10. For example, LEDs 50 or light sensors 50 can be made in a native compound semiconductor wafer. Similarly, pixel control circuits 24 can be separately formed in a semiconductor wafer such as a silicon wafer e.g., in CMOS. LEDS 50, light sensors 50, or pixel control circuits 24 are then removed from their respective source wafers and transferred, for example using micro-transfer printing, to array substrate 10 or pixel substrate 28. Such arrangements have the advantage of using a crystalline semiconductor substrate that provides higher-performance integrated circuit components than can be made in the amorphous or polysilicon semiconductor available in thin-film circuits on a large substrate such as array substrate 10. Such micro-transferred LEDs 50 or light sensors 50 or pixel control circuits 24 can comprise a broken (e.g., fractured) or separated tether 26 as a consequence of a micro-transfer printing process.

By employing a multi-step transfer or assembly process, increased yields are achieved and thus reduced costs for flat-panel pixel arrays 90 of the present disclosure. Additional details useful in understanding and performing aspects of the present disclosure are described in U.S. patent application Ser. No. 14/743,981, filed Jun. 18, 2015, entitled Micro Assembled Micro LED Displays and Lighting Elements, the disclosure of which is hereby incorporated by reference herein in its entirety.

As is understood by those skilled in the art, the terms "over", "under", "above", "below", "beneath", and "on" are relative terms and can be interchanged in reference to different orientations of the layers, elements, and substrates included in the present disclosure. For example, a first layer on a second layer, in some embodiments means a first layer directly on and in contact with a second layer. In other embodiments, a first layer on a second layer can include another layer there between.

As is also understood by those skilled in the art, the terms "column" and "row", "horizontal" and "vertical", and "x" and "y", "top" and "bottom", and "left" and "right" are arbitrary designations that can be interchanged (unless otherwise clear from context).

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as operability is maintained. Moreover, two or more steps or actions in some circumstances can be conducted simultaneously. The disclosure has been described in detail with particular express reference to certain embodiments thereof, but it will be understood that variations and modifications can be effected within the spirit and scope of the following claims.

PARTS LIST

G ground
P power
R resistor
T transistor
10 array substrate/display substrate/image sensor substrate
12 array/pixel array
20, 20A, 20B, 20C, 20D pixel
22 pixel light circuit
24 pixel control circuit
25 pixel controller substrate
26 tether
28 pixel substrate
30C column controller
30R row controller
31 first wire segment
31C first column wire segment
31R first row wire segment
32 second wire segment
32C second column wire segment
32R second row wire segment
40C pixel column
40R pixel row
42C column line
42R row line
50 light emitter/light-emitting diode (LED)/micro-light-emitting diode (micro-LED)/light sensor
52 red light-emitting diode
54 green light-emitting diode
56 blue light-emitting diode
61C first column subset of pixels in a column
61R first row subset of pixels in a row
62C second column subset of pixels in a column
62R second row subset of pixels in a row
70 signal regeneration circuit
70C column signal regeneration circuit
70R row signal regeneration circuit
72 dielectric structure
74 electrode

80 pixel array controller/display controller/image sensor controller
90 flat-panel pixel array
100 provide flat-panel pixel array step
110 select row step
120 row controller send row select to first row wire segment
130 next signal regeneration circuit regenerates row select on next row wire segment step
140 pixel controllers receive row select step
150 column controller sends column data to first column wire segment step
155 column controller receives column data from first column wire segment step
160 next signal regeneration circuit regenerates column data onto next column wire segment step
165 next signal regeneration circuit regenerates column data from next column wire segment step
170 pixel controllers in selected row input column data step
175 pixel controllers in selected row output column data step
180 pixel controllers in selected row drive pixel light emitters step
185 pixel controllers in selected row receive sensed pixel light step
190 next row step
200 receive image step

What is claimed:

1. A flat-panel pixel array, comprising:

an array of pixels distributed in rows and columns;

a first wire segment electrically connected to a first subset of pixels in a row or column of pixels;

a second wire segment electrically connected to a second subset of pixels in the row or column of pixels; and a signal regeneration circuit electrically connected to the first wire segment and to the second wire segment that is operable to regenerate a signal conducted on the first wire segment and drive the regenerated signal onto the second wire segment or that is operable to regenerate a signal conducted on the second wire segment and drive the regenerated signal onto the first wire segment, wherein the signal regeneration circuit does not store the signal.

2. The flat-panel pixel array of claim 1, wherein the array of pixels is an array of energy-emitting pixels or an array of energy-sensing pixels.

3. The flat-panel pixel array of claim 1, comprising a substrate and wherein (i) the array of pixels is disposed on the substrate, (ii) the first wire segment is disposed on the substrate, (iii) the second wire segment is disposed on the substrate, (iv) the signal regeneration circuit is disposed on the substrate, or (v) any combination of (i), (ii), (iii), and (iv).

4. The flat-panel pixel array of claim 1, wherein the first subset of pixels is mutually exclusive with respect to the second subset of pixels.

5. The flat-panel pixel array of claim 1, wherein (i) the pixels in the first subset of pixels are adjacent, (ii) the pixels in the second subset of pixels are adjacent, (iii) the first wire segment is adjacent to the second wire segment, or (iv) any combination of (i), (ii), and (iii).

6. The flat-panel pixel array of claim 1, further comprising:

a third wire segment electrically connected to a third subset of pixels in the row or column of pixels; and a second signal regeneration circuit electrically connected to the second wire segment and to the third wire segment that is operable to regenerate a signal conducted on the second wire segment and drive the regenerated signal onto the third wire segment or that is operable to regenerate a signal conducted on the third wire segment and drive the regenerated signal onto the second wire segment.

7. The flat-panel pixel array of claim 1, comprising an array substrate and wherein the signal regeneration circuit is a signal regeneration integrated circuit having a circuit substrate distinct from the array substrate.

8. The flat-panel pixel array of claim 7, wherein the signal regeneration integrated circuit is a micro-transfer printed integrated circuit comprising or physically attached to a broken or separated tether.

9. The flat-panel pixel array of claim 1, wherein each of the pixels comprises a pixel control circuit that is an integrated circuit having a circuit substrate distinct from the array substrate.

10. The flat-panel pixel array of claim 9, wherein the integrated circuit is a micro-transfer printed integrated circuit comprising or physically attached to a broken or separated tether.

11. The flat-panel pixel array of claim 9, wherein the pixel control circuit for at least one pixel of the first subset of pixels and the signal regeneration circuit are comprised in a common integrated circuit.

12. The flat-panel pixel array of claim 1, wherein the first wire segment and the second wire segment are first and second row wire segments electrically connected to at least a portion of a row of pixels in the array, the first subset of pixels is a first row subset and the second subset of pixels is a second row subset, the signal regeneration circuit is a row signal regeneration circuit, the signal is a row signal, and the flat-panel pixel array comprises:

a first column wire segment electrically connected to a first column subset of pixels in a column of pixels in the array;

a second column wire segment electrically connected to a second column subset of pixels in the column of pixels; and a column signal regeneration circuit electrically connected to the first column wire segment and to the second column wire segment that is operable to regenerate a column signal conducted on the first column wire segment and drive the regenerated column signal onto the second column wire segment or that is operable to regenerate a column signal conducted on the second column wire segment and drive the regenerated column signal onto the first column wire segment.

13. The flat-panel pixel array of claim 12, wherein the first column wire segment is electrically connected to conduct a signal between a column controller and the first column subset of pixels.

14. The flat-panel pixel array of claim 1, wherein the first subset of pixels comprises one pixel, the second subset of pixels comprises one pixel, and the flat-panel pixel array comprises a separate wire segment electrically connected to each pixel in the row or column of pixels and a separate signal regeneration circuit electrically connected to each separate wire segment and to a wire segment adjacent to each separate wire segment in the row or column of pixels that regenerates a signal conducted on each the separate wire segment and drives the regenerated signal onto the adjacent wire segment or that regenerates a signal conducted on the adjacent wire segment and drives the regenerated signal onto the each separate wire segment.

15. The flat-panel pixel array of claim 1, wherein the first wire segment is electrically connected to conduct a signal between a controller and the first subset of pixels.

16. The flat-panel pixel array of claim 1, wherein:

first and second wire segments are electrically connected to first and second subsets of pixels in each row or column of pixels, the first subset of pixels electrically conducting a signal between the controller and the first subset of pixels; and a separate signal regeneration circuit electrically connected to the first wire segment and to the second wire segment of each row or column that regenerates a signal conducted on the first wire segment of the row or column and drives the regenerated signal onto the second wire segment of the row or column or that regenerates a signal conducted on the second wire segment of the row or column and drives the regenerated signal onto the first wire segment of the row or column.

17. The flat-panel pixel array of claim 1, wherein the signal regeneration circuit is further electrically connected to a third wire segment and to a fourth wire segment, both distinct from the first wire segment and the second wire segment, wherein the signal regeneration circuit is operable to regenerate a signal conducted on the third wire segment and drive the regenerated signal onto the fourth wire segment or that is operable to regenerate a signal conducted on the fourth wire segment and drive the regenerated signal onto the third wire segment.

18. The flat-panel pixel array of claim 1, wherein (i) the first subset of pixels comprises two or more pixels connected in parallel to the first wire segment or (ii) the second subset of pixels comprises two or more pixels connected in parallel to the second wire segment, or (iii) both (i) and (ii).

19. The flat-panel pixel array of claim 1, wherein a temporal delay between conduction of the signal on the first wire segment and regeneration of the signal on the second wire segment is equal to a switching time of the signal regeneration circuit plus a propagation time of the signal along the first wire segment.

20. A flat-panel pixel array, comprising:

an array of pixels distributed in rows and columns and electrically connected with row lines and column lines; and an array of signal regeneration circuits distributed throughout the array of pixels, wherein each of the signal regeneration circuits is independently electrically connected to two or more of the row lines or two or more of the column lines, wherein each of the signal regeneration circuits is operable to regenerate a signal conducted on each row line of the two or more row lines or to regenerate a signal conducted on each column line of the two or more column lines, and wherein each of the signal regeneration circuits does not store the signal.

21. A flat-panel pixel array, comprising:

an array of pixels distributed in rows and columns and electrically connected with row lines and column lines; and a plurality of signal regeneration circuits, wherein each of the signal regeneration circuits is electrically connected to at least one of the row lines or column lines and operable to regenerate a signal conducted on the at least one of the row lines or column lines, wherein each of the signal regeneration circuits does not store the signal.

22. The flat-panel pixel array of claim 21, wherein each of the row lines and each of the column lines comprises a first line segment and a second line segment and each of the signal regeneration circuits is electrically connected to the first wire segment and to the second wire segment of at least one of the row lines or column lines and operable to regenerate a signal conducted on the first wire segment and drive the regenerated signal onto the second wire segment or that is operable to regenerate a signal conducted on the second wire segment and drive the regenerated signal onto the first wire segment.

* * * * *